US008955413B2

(12) United States Patent
Bijai et al.

(10) Patent No.: US 8,955,413 B2
(45) Date of Patent: Feb. 17, 2015

(54) MANUFACTURING METHODS FOR HIGH SHEAR ROLLER CONE BITS

(75) Inventors: Rahul Bijai, Spring, TX (US); Zhehua Zhang, The Woodlands, TX (US); Vikrant Bhadbhade, Spring, TX (US); Prabhakaran K. Centala, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 695 days.

(21) Appl. No.: 12/844,589

(22) Filed: Jul. 27, 2010

(65) Prior Publication Data

US 2011/0023663 A1 Feb. 3, 2011

Related U.S. Application Data

(60) Provisional application No. 61/230,535, filed on Jul. 31, 2009.

(51) Int. Cl.

| | |
|---|---|
| ***B21K 5/04*** | (2006.01) |
| ***B23P 15/32*** | (2006.01) |
| ***E21B 10/08*** | (2006.01) |
| ***E21B 10/20*** | (2006.01) |
| ***E21B 10/50*** | (2006.01) |

(52) U.S. Cl.

CPC ..... *E21B 10/08* (2013.01); *E21B 10/20* (2013.01); *E21B 10/50* (2013.01)

USPC ..... 76/108.1

(58) Field of Classification Search

CPC ..... B21K 5/04; B23P 15/32

USPC ..... 76/108.1–108.6; 175/351–356

See application file for complete search history.

(56) References Cited

U.S. PATENT DOCUMENTS

| | | | | | |
|---|---|---|---|---|---|
| 334,594 | A | * | 1/1886 | Maloy | 175/351 |
| 1,026,886 | A | * | 5/1912 | Thomas | 175/351 |
| 1,124,241 | A | | 1/1915 | Hughes | |
| 1,124,242 | A | | 1/1915 | Hughes | |
| 1,124,243 | A | * | 1/1915 | Hughes | 175/352 |
| 1,131,701 | A | * | 3/1915 | Hughes | 175/351 |
| 1,143,273 | A | | 6/1915 | Hughes | |
| 1,143,274 | A | * | 6/1915 | Hughes | 175/351 |
| 1,143,275 | A | | 6/1915 | Hughes | |

(Continued)

FOREIGN PATENT DOCUMENTS

| | | | |
|---|---|---|---|
| DE | 19521447 | A1 | 12/1996 |
| GB | 2167107 | A | 5/1986 |

(Continued)

OTHER PUBLICATIONS

"The Disc Bit—A Tool for Hard-Rock Drilling", J.C.R. Placido and J.E. Friant; Dec. 2004 SPE Drilling & Completion; pp. 205-211.

(Continued)

*Primary Examiner* — Jason Daniel Prone

(74) *Attorney, Agent, or Firm* — Osha Liang LLP

(57) ABSTRACT

A method of manufacturing a roller cone drill bit may include forming a body of a single piece having an upper end and a lower end; machining at the lower end of the body at least two journals extending downward and radially outward from a central axis of the body; machining at least one of a ball passage, a hydraulic fluid passageway, a grease reservoir, and a lubricant passageway; and mounting roller cones on the at least two journals.

19 Claims, 22 Drawing Sheets

(56) References Cited

U.S. PATENT DOCUMENTS

| | | | | | |
|---|---|---|---|---|---|
| 1,182,533 | A | | 5/1916 | Double | |
| 1,195,208 | A | * | 8/1916 | Griffin | 175/354 |
| 1,327,913 | A | * | 1/1920 | Hughes | 175/355 |
| 1,348,419 | A | * | 8/1920 | Hughes | 175/355 |
| 1,374,867 | A | * | 4/1921 | Wadsworth | 175/355 |
| 1,402,684 | A | * | 1/1922 | Thomas | 175/351 |
| 1,747,908 | A | * | 2/1930 | Seifert | 175/354 |
| 1,812,475 | A | * | 6/1931 | Gildersleeve et al. | 175/354 |
| 1,850,358 | A | * | 3/1932 | Scott | 175/351 |
| 1,877,225 | A | | 9/1932 | Capeliuschnicoff | |
| 2,121,202 | A | | 6/1938 | Killgore | |
| 2,174,587 | A | * | 10/1939 | Love | 175/353 |
| 2,634,955 | A | | 4/1953 | Johnson | |
| 2,742,439 | A | * | 4/1956 | Hallett | 175/353 |
| 2,915,291 | A | | 12/1959 | Gulfett | |
| 3,743,037 | A | * | 7/1973 | Bulakh et al. | 175/354 |
| 3,923,109 | A | | 12/1975 | Williams, Jr. | |
| 3,945,447 | A | * | 3/1976 | Peterson | 175/376 |
| 4,127,043 | A | | 11/1978 | Evans | |
| 4,136,586 | A | | 1/1979 | Neilson et al. | |
| 4,145,094 | A | | 3/1979 | Vezirian | |
| 4,158,973 | A | * | 6/1979 | Schumacher et al. | 76/108.2 |
| 4,176,724 | A | | 12/1979 | Vezirian | |
| 4,187,743 | A | * | 2/1980 | Thomas | 76/108.2 |
| 4,204,437 | A | * | 5/1980 | Espana | 76/108.2 |
| 4,209,890 | A | * | 7/1980 | Koskie, Jr. | 76/108.1 |
| 4,333,364 | A | | 6/1982 | Varel | |
| 4,350,060 | A | | 9/1982 | Vezirian | |
| 4,417,629 | A | * | 11/1983 | Wallace | 76/108.2 |
| 4,446,935 | A | | 5/1984 | Schumacher, Jr. | |
| 4,549,614 | A | | 10/1985 | Kaalstad et al. | |
| 4,610,317 | A | | 9/1986 | England et al. | |
| 4,694,551 | A | | 9/1987 | Mathews | |
| 4,751,972 | A | | 6/1988 | Jones et al. | |
| 4,765,205 | A | | 8/1988 | Higdon | |
| 4,796,713 | A | | 1/1989 | Bechem et al. | |
| 4,819,517 | A | * | 4/1989 | Vezirian | 76/108.2 |
| 4,832,143 | A | * | 5/1989 | Kaalstad et al. | 175/365 |
| 4,874,047 | A | | 10/1989 | Hixon | |
| 4,924,954 | A | | 5/1990 | Mead | |
| 4,942,930 | A | * | 7/1990 | Millsapps, Jr. | 76/108.2 |
| 4,953,641 | A | | 9/1990 | Pessier | |
| 5,064,007 | A | | 11/1991 | Kaalstad | |
| 5,147,000 | A | | 9/1992 | Kaalstad | |
| 5,189,932 | A | | 3/1993 | Palmo et al. | |
| 5,201,795 | A | | 4/1993 | Howard et al. | |
| 5,358,061 | A | | 10/1994 | Van Nguyen | |
| 5,439,068 | A | * | 8/1995 | Huffstutler et al. | 76/108.4 |
| 5,452,770 | A | | 9/1995 | Millsapps, Jr. | |
| 5,505,273 | A | | 4/1996 | Azar et al. | |
| 5,524,510 | A | | 6/1996 | Davies et al. | |
| 5,586,612 | A | | 12/1996 | Isbell et al. | |
| 5,592,996 | A | | 1/1997 | Keith et al. | |
| 5,598,895 | A | * | 2/1997 | Anderson et al. | 175/352 |
| 5,606,895 | A | | 3/1997 | Huffstutler | |
| 5,636,700 | A | * | 6/1997 | Shamburger, Jr. | 76/108.4 |
| 5,641,029 | A | * | 6/1997 | Beaton et al. | 76/108.2 |
| 5,695,018 | A | | 12/1997 | Pessier et al. | |
| 5,695,019 | A | * | 12/1997 | Shamburger, Jr. | 76/108.2 |
| 5,839,525 | A | | 11/1998 | Hoffmaster et al. | |
| 5,975,223 | A | * | 11/1999 | Karlsson | 76/108.2 |
| 6,321,858 | B1 | | 11/2001 | Wentworth et al. | |
| 6,345,673 | B1 | | 2/2002 | Siracki | |
| 6,439,326 | B1 | | 8/2002 | Huang et al. | |
| 6,450,271 | B1 | * | 9/2002 | Tibbitts et al. | 76/108.2 |
| 6,561,292 | B1 | | 5/2003 | Portwood | |
| 6,568,490 | B1 | * | 5/2003 | Tso et al. | 76/108.2 |
| 6,779,613 | B2 | | 8/2004 | Dykstra et al. | |
| 6,810,971 | B1 | | 11/2004 | Sved | |
| 6,827,159 | B2 | | 12/2004 | Sved | |
| 6,935,443 | B2 | | 8/2005 | Ehler et al. | |
| 7,195,085 | B2 | * | 3/2007 | Pia | 175/353 |
| 7,341,119 | B2 | | 3/2008 | Singh et al. | |
| 7,464,773 | B2 | * | 12/2008 | Rives | 175/353 |
| 8,672,060 | B2 | * | 3/2014 | Centala et al. | 175/359 |
| 2001/0054514 | A1 | * | 12/2001 | Sullivan et al. | 76/108.4 |
| 2002/0000336 | A1 | * | 1/2002 | Claesson et al. | 76/108.2 |
| 2002/0029909 | A1 | * | 3/2002 | Griffo et al. | 76/108.2 |
| 2007/0062736 | A1 | | 3/2007 | Cariveau et al. | |
| 2008/0011519 | A1 | * | 1/2008 | Smith et al. | 76/108.2 |
| 2009/0057030 | A1 | * | 3/2009 | Didericksen et al. | 76/108.2 |
| 2009/0272582 | A1 | | 11/2009 | McCormick et al. | |
| 2010/0163313 | A1 | * | 7/2010 | Lin et al. | 76/108.2 |
| 2011/0162893 | A1 | * | 7/2011 | Zhang | 76/108.4 |
| 2012/0031671 | A1 | | 2/2012 | Propes | |
| 2014/0196956 | A1 | * | 7/2014 | Centala et al. | 175/371 |

FOREIGN PATENT DOCUMENTS

| | | | |
|---|---|---|---|
| GB | 2203470 | A | 10/1988 |
| GB | 2384503 | A | 7/2003 |
| WO | 2008124572 | A1 | 10/2008 |
| WO | WO 2011014590 | A3 * | 4/2011 |
| WO | WO 2011014591 | A3 * | 4/2011 |
| WO | WO 2011084944 | A3 * | 10/2011 |

OTHER PUBLICATIONS

International Search Report with Written Opinion issued in International Application No. PCT/US2010/043604 dated Mar. 3, 2011 (8 pages).

International Search Report with Written Opinion issued in International Application No. PCT/US/2010/043603 dated Mar. 2, 2011 (8 pages).

International Search Report with Written Opinion issued in related International Application No. PCT/US2011/020091 dated Jun. 23, 2011 (8 pages).

* cited by examiner

--PRIOR ART--

MANUFACTURING METHODS FOR HIGH SHEAR ROLLER CONE BITS

CROSS-REFERENCE TO RELATED APPLICATIONS

This application claims priority to U.S. Patent Application No. 61/230,535, filed on Jul. 31, 2009, the contents of which are herein incorporated by reference.

BACKGROUND OF INVENTION

1. Field of the Invention

Embodiments disclosed herein relate generally to manufacturing methods for roller cone drill bits.

2. Background Art

Historically, there have been two main types of drill bits used drilling earth formations, drag bits and roller cone bits. The term "drag bits" refers to those rotary drill bits with no moving elements. Drag bits include those having cutters attached to the bit body, which predominantly cut the formation by a shearing action. Roller cone bits include one or more roller cones rotatably mounted to the bit body. These roller cones have a plurality of cutting elements attached thereto that crush, gouge, and scrape rock at the bottom of a hole being drilled.

Roller cone drill bits typically include a main body with a threaded pin formed on the upper end of the main body for connecting to a drill string, and one or more legs extending from the lower end of the main body. Referring now FIGS. 1 and 2, a conventional roller cone drill bit, generally designated as 10, consists of bit body 12 forming an upper pin end 14 and a cutter end of roller cones 16 that are supported by legs 13 extending from body 12. Each leg 13 includes a journal (not shown) extending downwardly and radially inward towards a center line of the bit body 12, with cones 16 mounted thereon. Each of the legs 13 terminate in a shirttail portion 22. The threaded pin end 14 is adapted for assembly onto a drill string (not shown) for drilling oil wells or the like.

Conventional roller cone bits are typically constructed from at least three segments. The segments are often forged pieces having an upper body portion and a lower leg portion. The lower leg portion is machined to form the shirttail section and the journal section. Additionally, lubricant reservoir holes, jet nozzle holes, ball races are machined into the forgings. Cones are mounted onto the formed journals, and the leg segments are be positioned together longitudinally with journals and cones directed radially inward to each other. The segments may then be welded together using conventional techniques to form the bit body. Upon being welded together, the internal geometry of each leg section forms a center fluid plenum. The center fluid plenum directs drilling fluid from the drill string, out nozzles to cool and clean the bit and borehole, etc.

While roller cone bits have had a long presence in the market due to their overall durability and cutting ability (particularly when compared to previous bit designs, including disc bits), fixed cutter bits gained significant growths, particularly in view of the rates of penetration achievable. Accordingly, there exists a continuing need for developments in roller cone bits, as well as manufacturing techniques, that may at least provide for increased rates of penetration.

SUMMARY OF INVENTION

In one aspect, embodiments disclosed herein relate to a method of manufacturing a roller cone drill bit that may include forming a body of a single piece having an upper end and a lower end; machining at the lower end of the body at least two journals extending downward and radially outward from a central axis of the body; machining at least one of a ball passage, a hydraulic fluid passageway, a grease reservoir, and a lubricant passageway; and mounting roller cones on the at least two journals.

In another aspect, embodiments disclosed herein relate to a method of manufacturing a roller cone drill bit that may include forming at least two leg sections having an upper end and a lower end; machining at the lower end of each leg section a journal; welding the at least two leg sections together to form a bit body such that the journal of each leg section points downward and radially outward; and mounting roller cones on the at least two journals.

In yet another aspect, embodiments disclosed herein relate to a method of manufacturing a roller cone drill bit that may include forming an upper bit body section having an upper end and a lower end; forming at least two leg lower sections having an upper end and a lower end; machining at the lower end of each leg section a journal; welding the at least two leg sections together to form a lower bit body section such that the journal of each leg section points downward and radially outward; welding the upper end lower bit body section to the lower end of the upper section to form a bit body; and mounting roller cones on the at least two journals.

Other aspects and advantages of the invention will be apparent from the following description and the appended claims.

DETAILED DESCRIPTION

Figure 1:
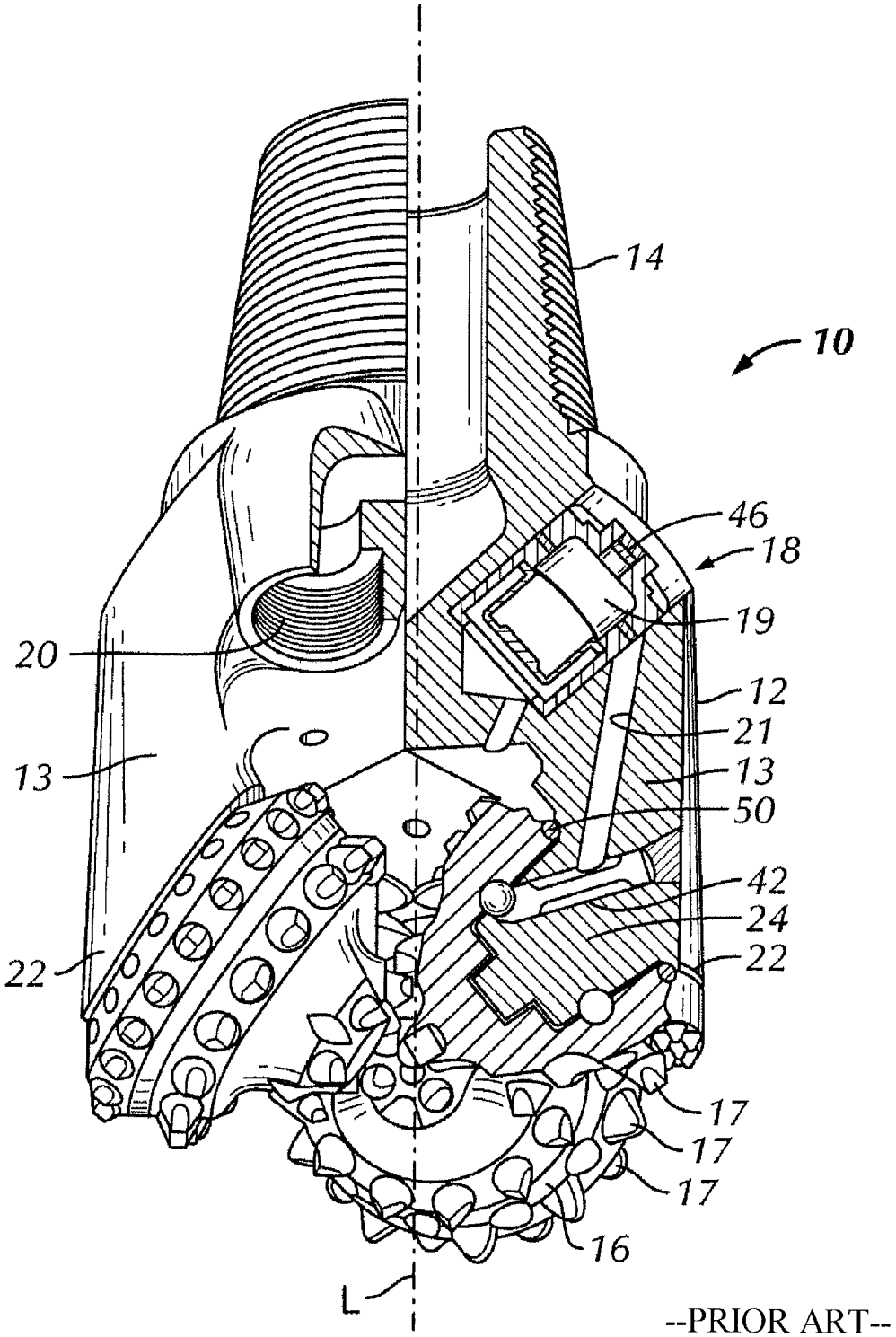
FIG. 1 is a semi-schematic perspective of a conventional three cone roller cone bit.

In one aspect, embodiments disclosed herein relate to manufacturing of roller cone drill bits having outwardly facing roller cones. Outwardly facing refers to cones attached to a drill bit where the noses of the plurality of cones are angled radially outward. Use of such cone configuration requires unique manufacturing considerations, as compared to conventional roller cone bits, such as those shown in FIG. 1. In particular, not only are the cones outwardly facing, but this unique arrangement of the journals results in the inapplicability of conventional roller cone bit manufacturing techniques to the bits of the present disclosure including design and formation of the internal geometry, such as for lubrication and cone retention mechanisms.

Figure 2:
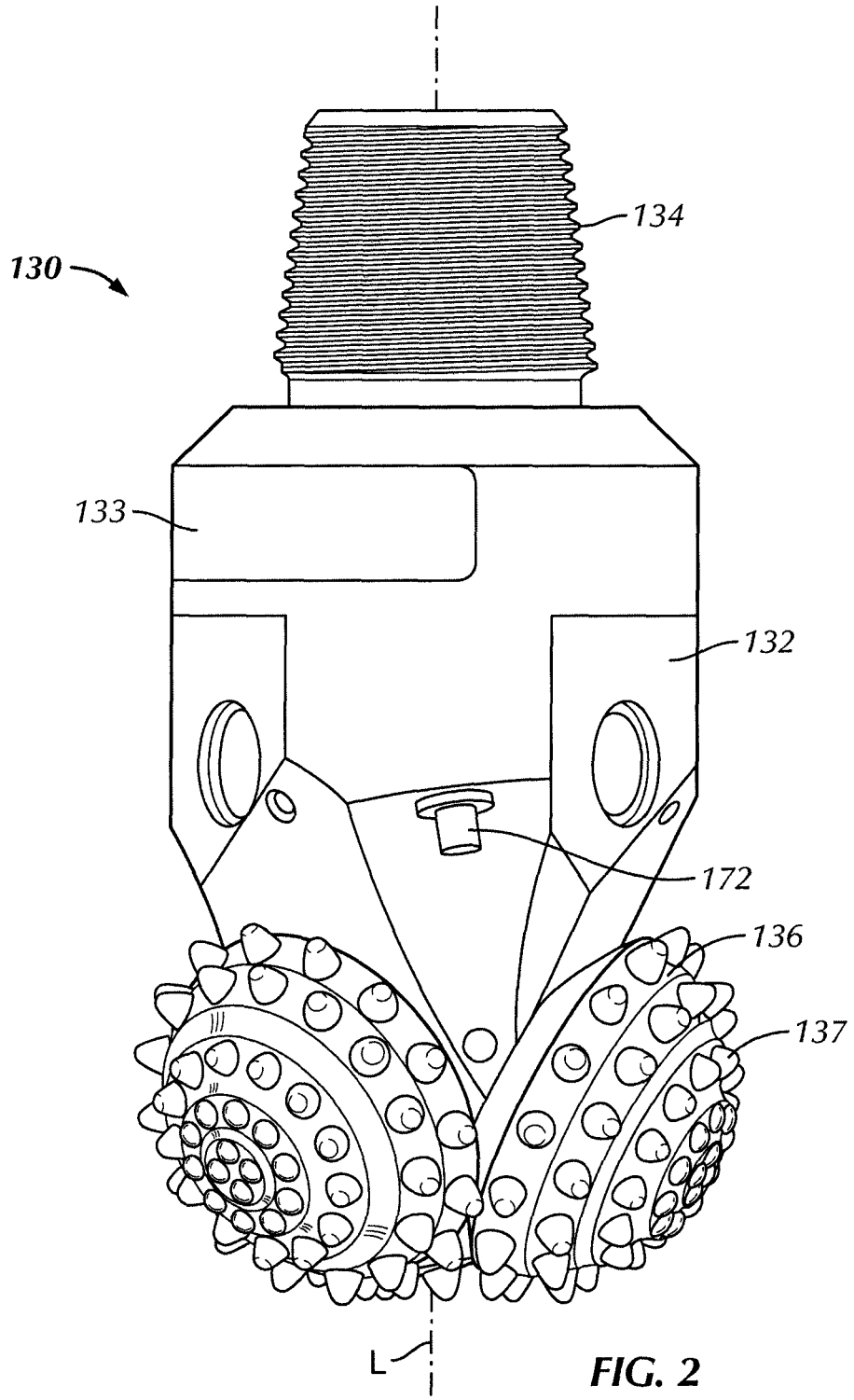
FIG. 2 is a side view of a roller cone bit manufactured in accordance with the methods of the present disclosure.
Figure 3:
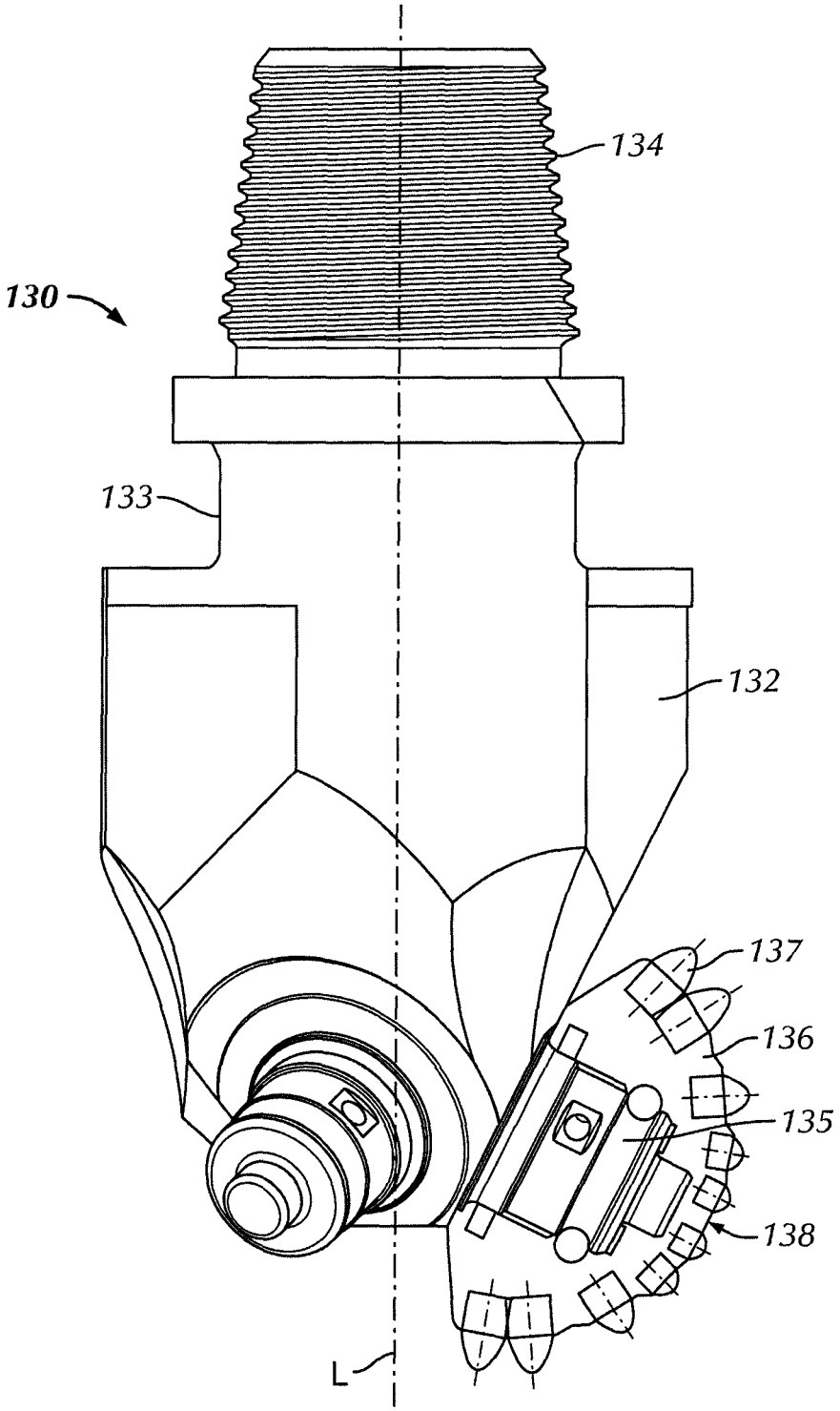
FIG. 3 is a semi-schematic perspective of a roller cone bit manufactured in accordance with methods of the present disclosure.

Referring to FIGS. 2 and 3, two views of a roller cone drill bit manufactured according to embodiments of the present disclosure are shown. As shown in FIG. 2, a roller cone drill bit 130 includes a bit body 132 having a threaded pin end 134 for coupling bit 130 to a drill string (not shown) at an upper end. At a lower end of bit 130 is the cutting end of bit 130. In particular, bit body 132 terminates at the lower end into a plurality of journals 135 (journals are integral with the rest of bit body). Each journal 135 extends downward and radially outward, away from longitudinal axis L of bit 130. On each journal 135, a roller cone 136 having a frustoconical shape is rotatably mounted. Each roller cone 136 has disposed thereon a plurality of rows of cutting elements 137, and in particular embodiments, at least three rows of cutting elements 137. Beneath threaded pin end 134, bit body 132 may optionally include bit breaker slots 133. Bit breaker slots 133 may be flat-bottomed recesses cut into the generally cylindrical outer surface of the bit body 132. Slots 133 facilitate bit breaker (not shown) engagement with the drill bit during the attachment or detachment of the threaded pin 134 into an internally threaded portion of a lower end of a drill string. Further, while FIGS. 2 and 3 show three-cone bits, the present application equally applies to methods of manufacturing two- or four-cone bits having outwardly facing roller cones.

A primary difference between the manufacturing methods of the present disclosure, as compared to that for a conventional roller cone bit, is that the cones are mounted on and secured to the bit body after the bit body (or at least the bottom half thereof) is assembled. Comparatively, for conventional roller cone bits, roller cones are attached to legs of bit body prior to assembly of the bit body. In conventional bits, the cones are retained on the journal by ball bearings, which are inserted into place through a ball passageway that extends a relative short distance through the bit from the outer leg surface radially inward to the journal. Conversely, for a bit of the present disclosure, the journals extend from proximate the bit center downward and radially outward. Thus, ball passageways must traverse a longer distance through the bit body (as compared to a conventional), creating additional design challenges. For example, if ball hole passageways are formed from the journal to the outer bit body surface approximately 180° from the journal, the ball passageways intercept at the bit center. Not only can this create manufacturing difficulties, but the interconnection between the ball passageways means the lubrication system for the cones are not isolated from one another. Because the ball passageways are interconnected, if they are not isolated from each other, one bearing/seal failure may result in failure of the other(s). Thus, while prior bits such as disc bits may have "outwardly" facing discs, no such bit included ball retention or lubricant systems as possessed by the bits of the present disclosure that presented the manufacturing challenges faced by the inventors of the present application.

Referring to FIGS. 4A-4I collectively, in one embodiment of the present disclosure, the bit body may be formed from a single piece or cut of bar stock. In particular, bar stock 110 is machined into a transitional bit body 111 having at least two protrusions 115 (three shown in FIG. 4B) at a lower end thereof. Protrusions 115 extend downward and radially outward from a centerline L of transitional bit body 111. One skilled in the art should appreciate after learning the teachings related to the present invention contained in this application that the direction, orientation, etc. of protrusion 115 (discussed in greater detail below) may be selected based on the ultimate desired direction, orientation, etc. of a bit body journal.

Figure 4A:
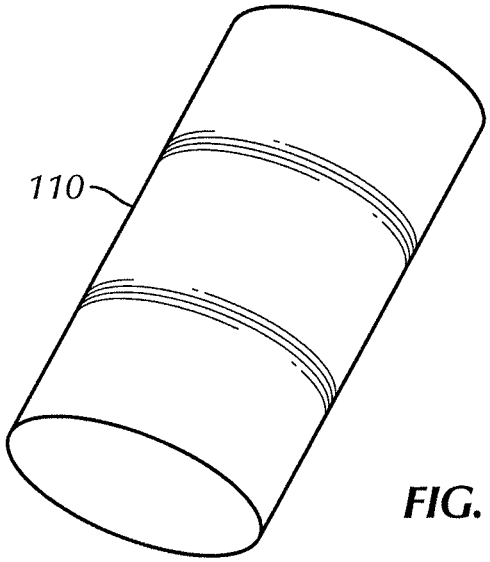
FIGS. 4A-4I show manufacturing stages of a roller cone bit in accordance with one embodiment of the present disclosure.
Figure 4B:
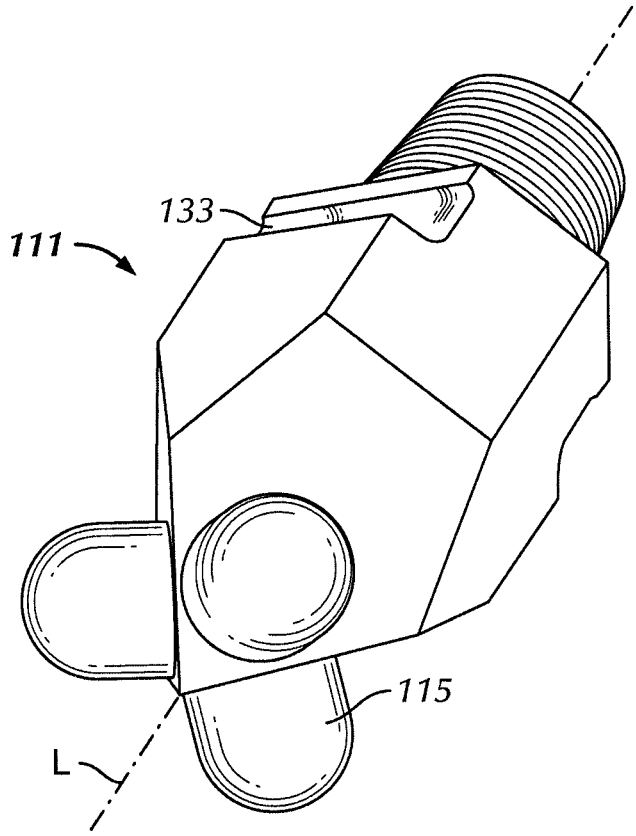
Figure 4C:
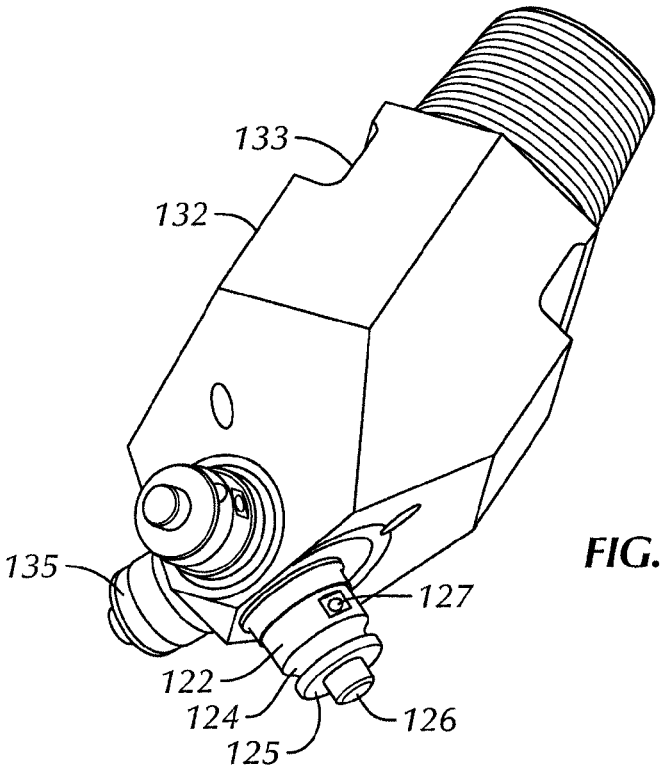

Following the initial machining, protrusions 115 may be machined into journals 135 extending downardly and radially outwardly from a centerline of bit body 132. In particular, as shown in FIG. 4C, protrusion 115 may be journal machined to have a cylindrical bearing surface (slightly recessed) 122. Below cylindrical bearing surface 122, a semi-spherical ball race 124 may be machined into the metal. Below ball race 124 is thrust flange 125 that is defined between ball race 124 and a cylindrical nose 126 (nose 126 has the smallest diameter of journal 135). In cylindrical bearing surface 122, a grease hole 127 may be machined a selected distance into the journal 135 for intersection with eventual ball passage (not shown). Such grease hole 127 may be machined at the time of journal machining or may be performed during the later formation of the ball passage.

Figure 4D:
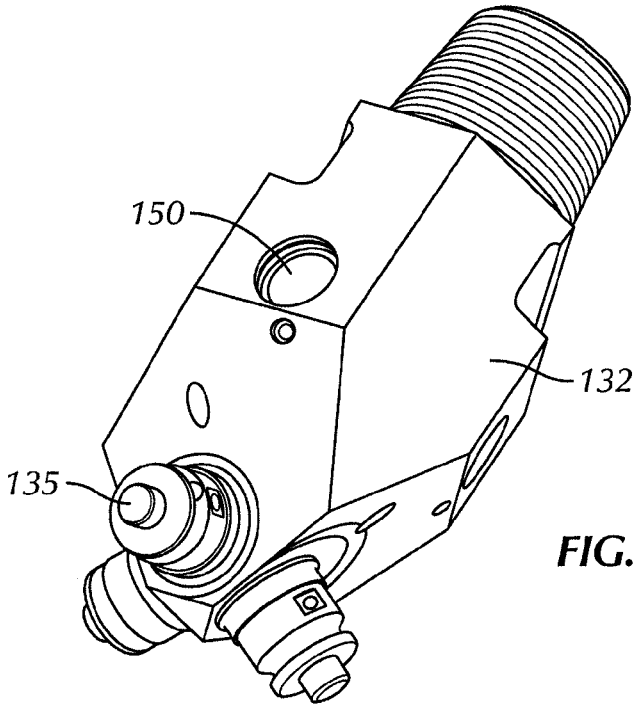
Figure 4E:
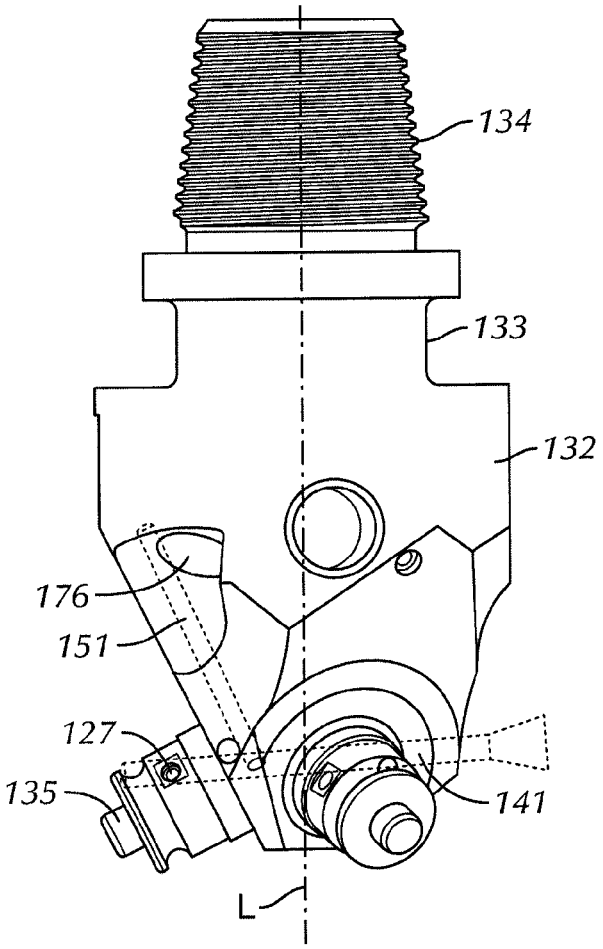
Figure 4F:
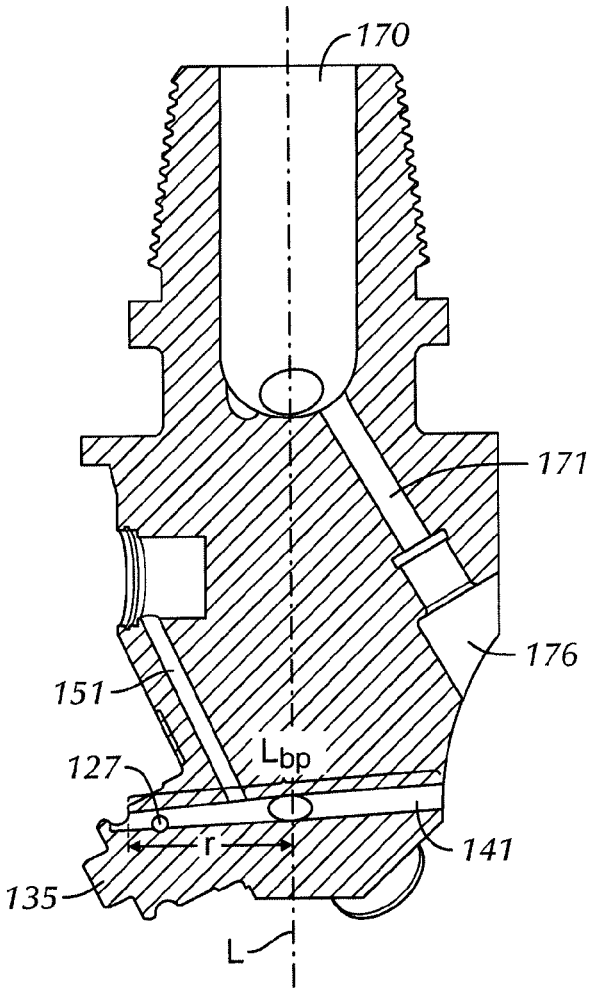
Figure 4G:
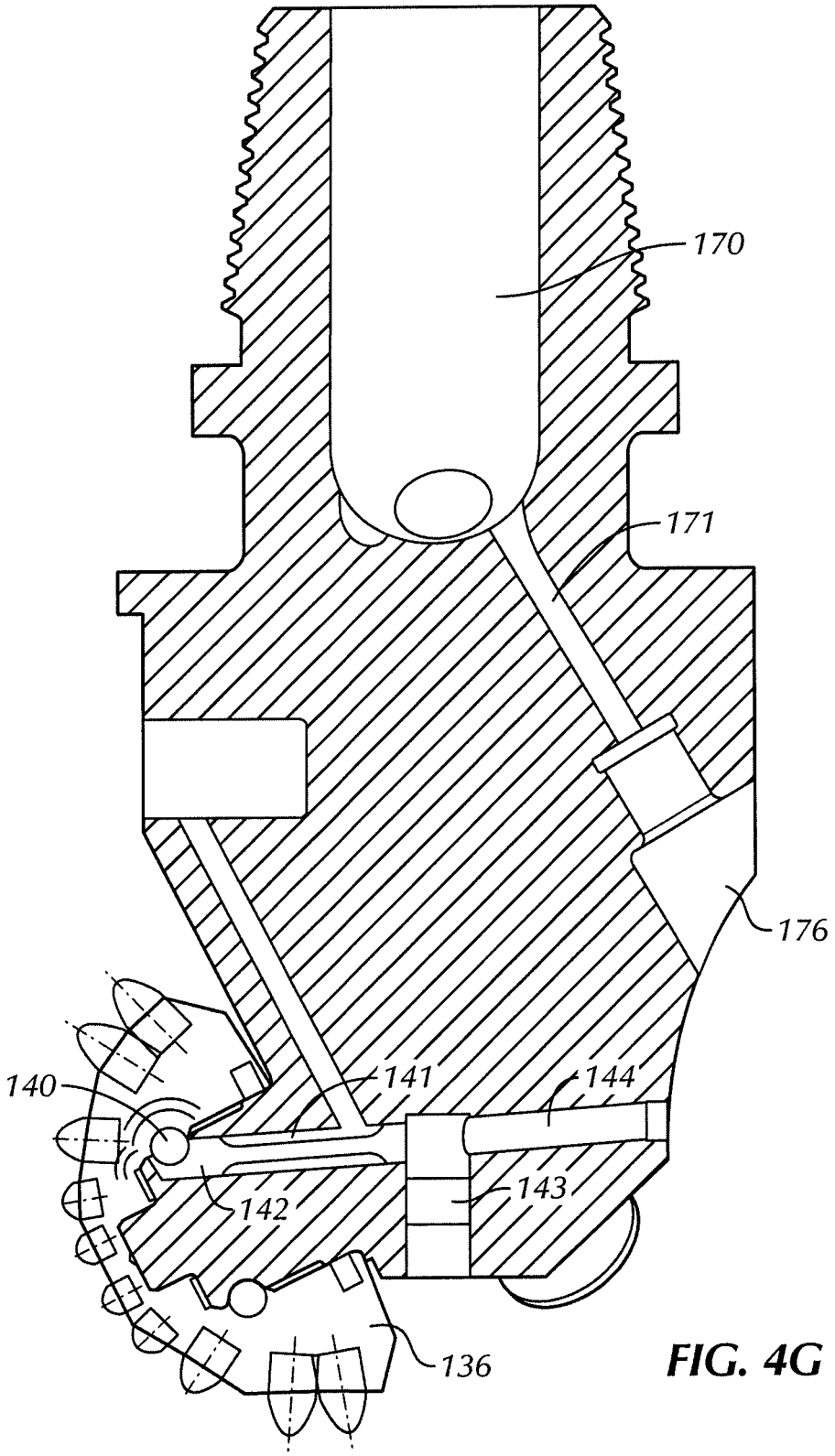
Figure 4H:
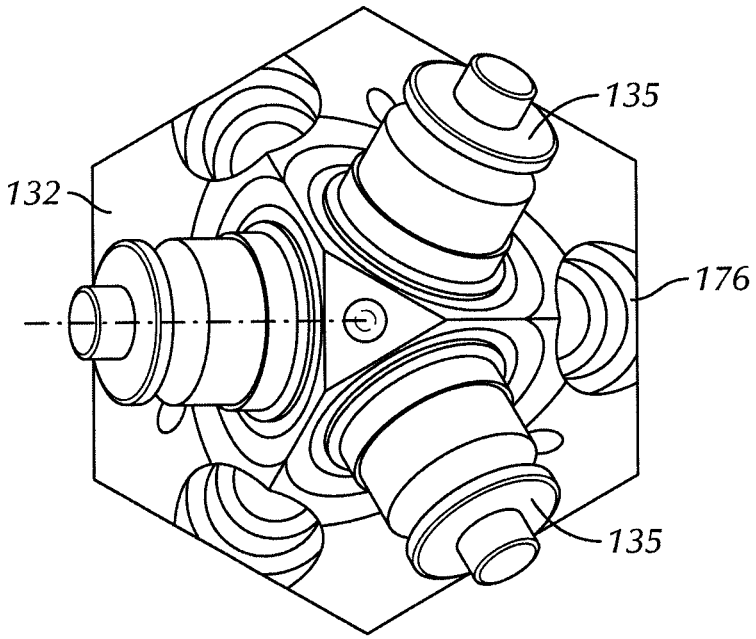
Figure 4I:
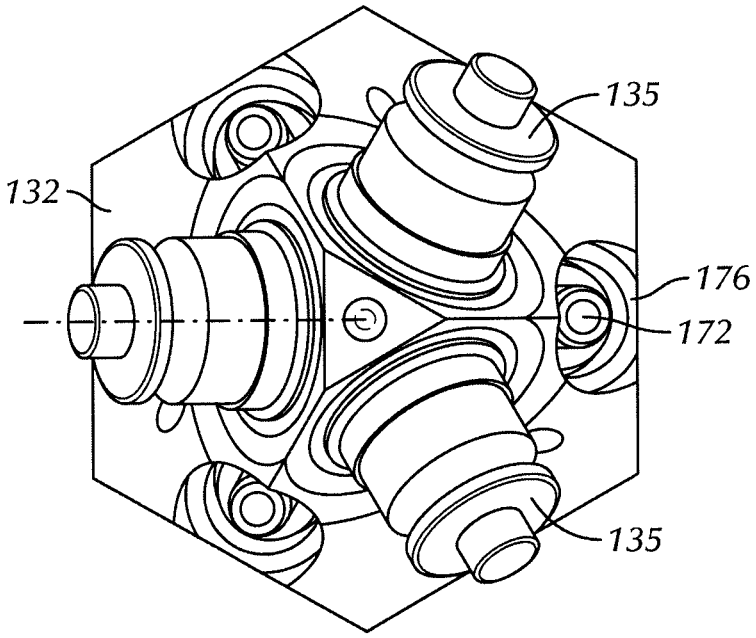
Figure 5A:
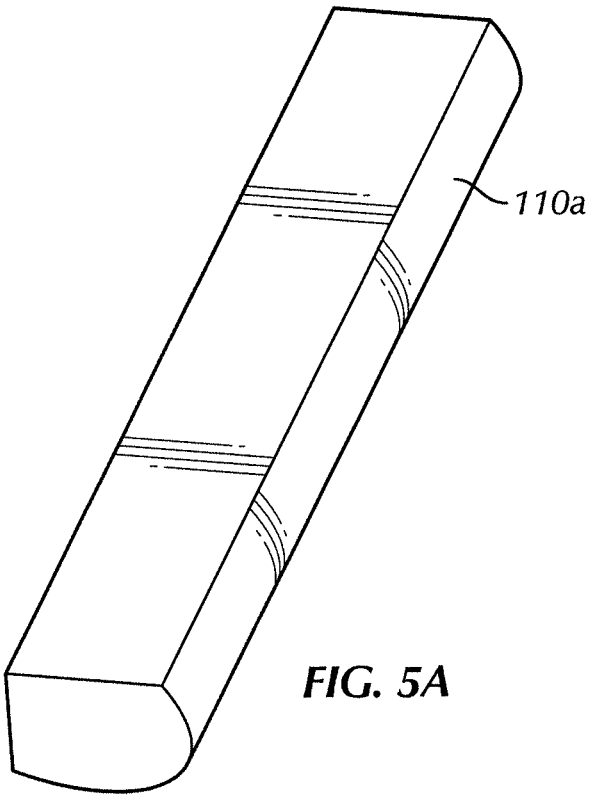
FIGS. 5A-5E show manufacturing stages of a roller cone bit in accordance with one embodiment of the present disclosure.
Figure 5B:
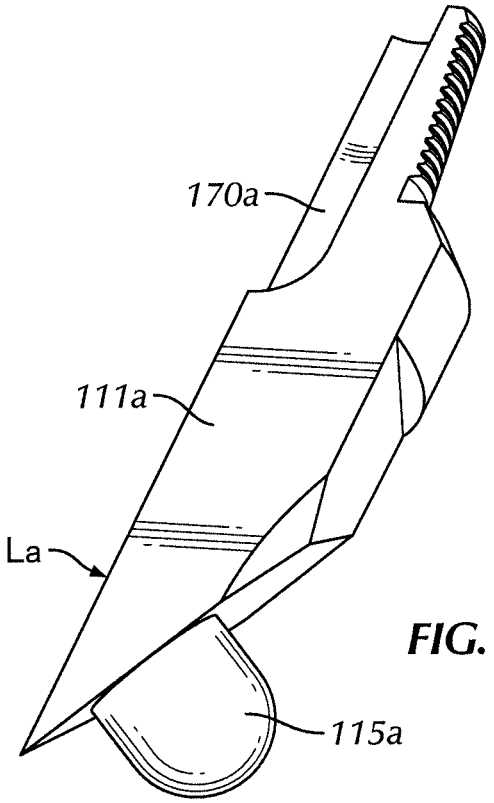
Figure 5C:
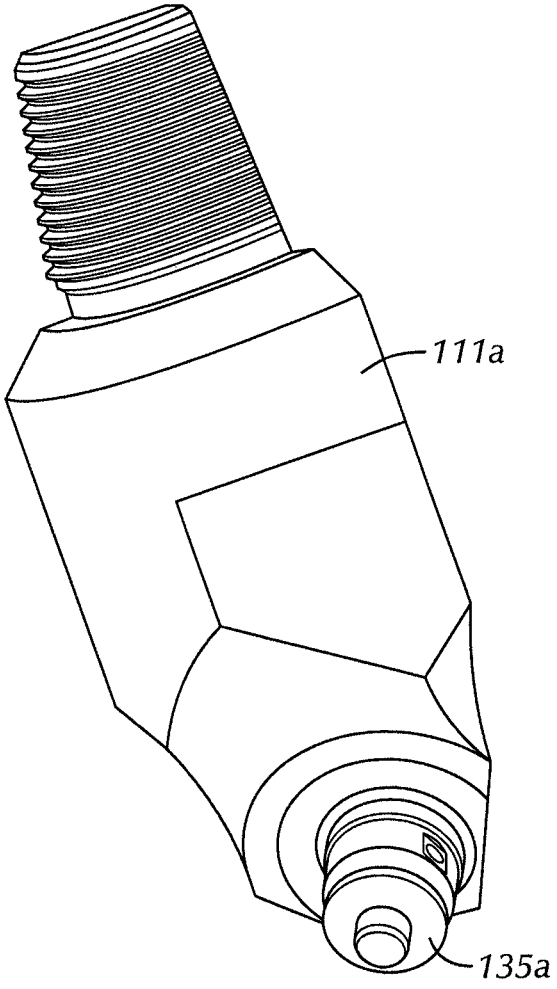
Figure 5D:
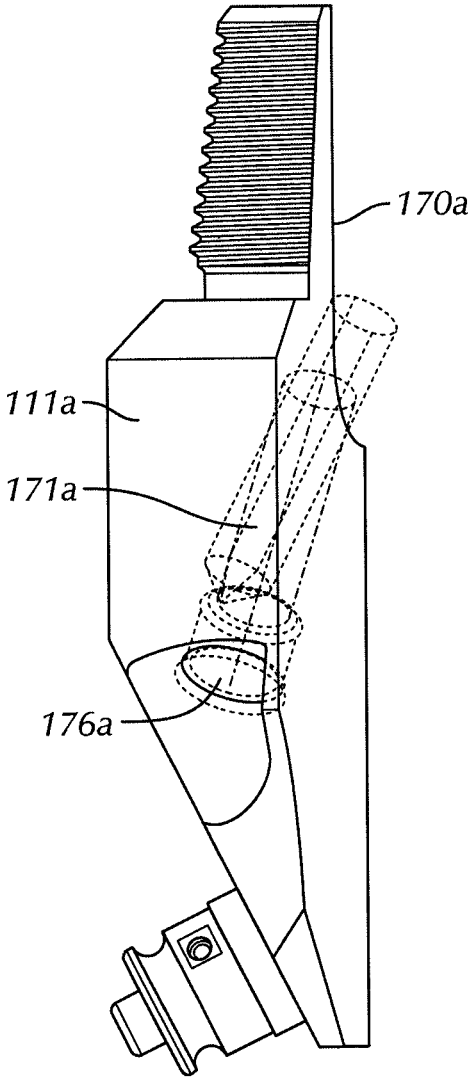
Figure 5E:
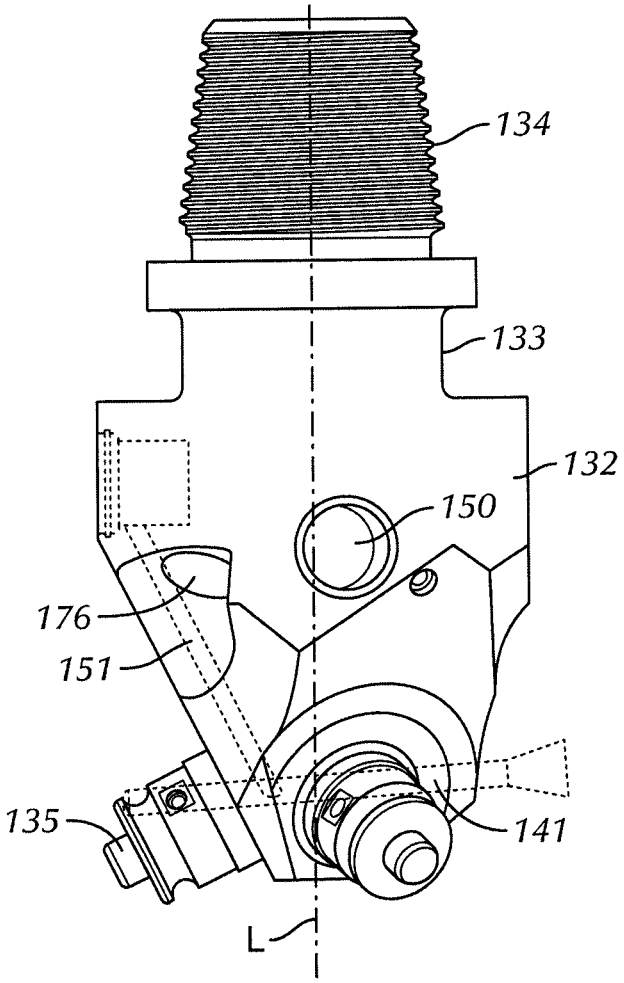
Figure 6A:
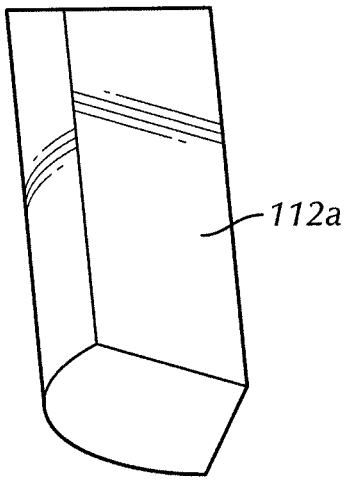
FIGS. 6A-6D show manufacturing stages of a roller cone bit in accordance with one embodiment of the present disclosure.
Figure 6B:
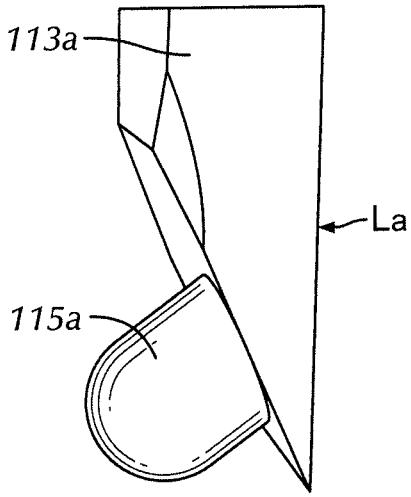
Figure 6C:
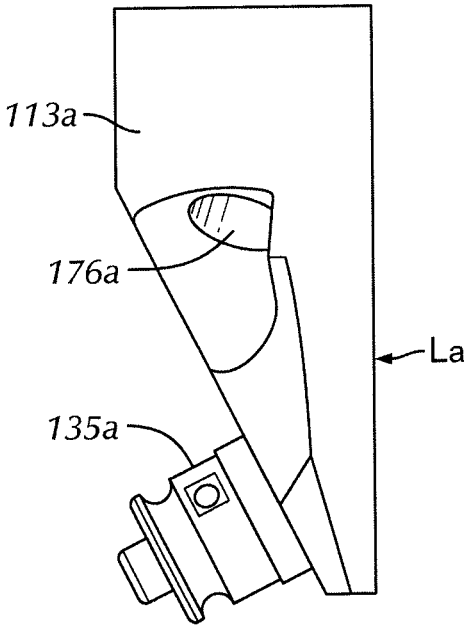
Figure 6D:
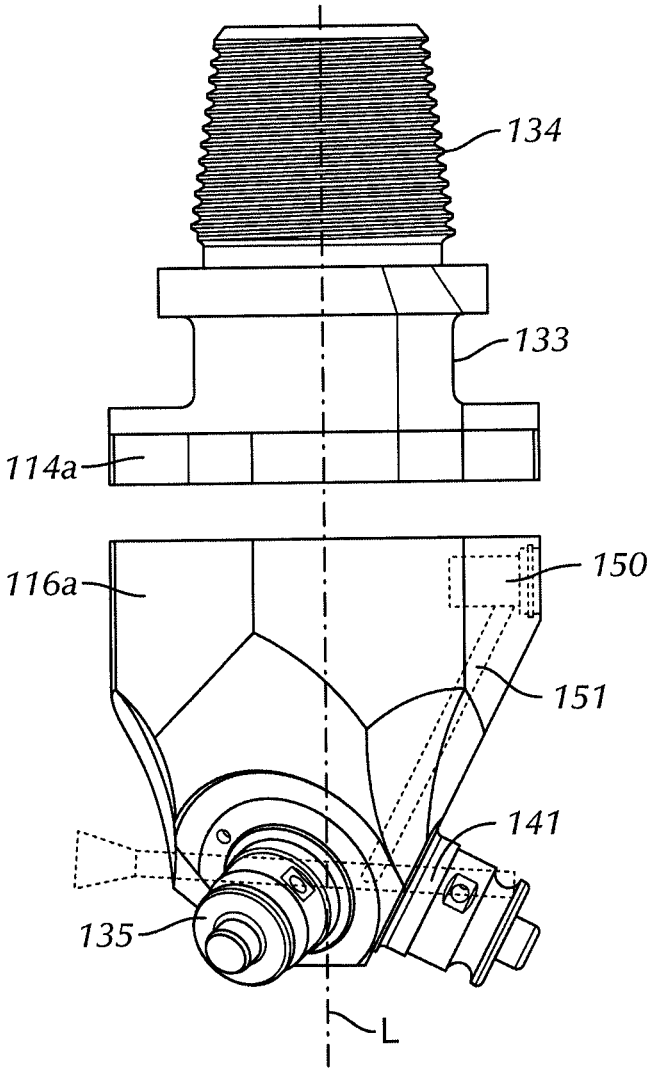

Prior to (or after) the journal machining, grease reservoirs 150 may be machined into the bit body 132 in a location axially above each journal 135, shown in FIG. 4D. Each reservoir 150 supplies grease for the journal 135 above which the reservoir 150 is located.

Grease reservoir 150 may be fluidly connected to grease hole 127 in an opposing journal by a long lube or grease passage 151 that extends downward and radially inward from grease reservoir 150 until intersecting ball passage 141. Ball passage 141 transverses bit body 132 a total length $L_{bp}$ that is greater than the length of the radius r from a centerline or longitudinal axis L of the bit to the opening in ball race 124. In a particular embodiment (for a three cone bit), ball passage 141 may be machined from a surface opposite (~180 degrees) from a journal 135 to the ball race 124 of that journal 135, intersecting a bit centerline L. Ball passage 141 may be machined prior to or after machining of grease reservoir, and lubricant passageway 151 may be machined after machining of grease reservoir. Side lube holes and pressure relief valves may also be incorporated into the bit, similar to those in conventional roller cone bits.

In addition to the holes and passages for the grease and ball retention system, a hydraulic opening 176 may be machined into an outer surface of the bit body 132 between two neighboring journals 135 at a position axially above journals 135. Additionally, hydraulic fluid passageways 171 may be machined from a center fluid plenum 170 to opening 176 so that fluid may exit bit from plenum 170 (in fluid communication with drill string (not shown)) through opening 176. Plenum may be machined or otherwise formed at any time during the bit manufacturing process, but preferably, before forming hydraulic fluid passageways 171. Nozzles 172 (and/or other hydraulic attachment pieces) may be attached to openings 176 at any time prior to use.

At any point after the machining of ball passage 141, cone 136 may be retained on journal 135 by retention balls 140, which are inserted through ball passage 141 and fill the space between corresponding ball races on the journal 135 and cone 136. A ball retainer 142 may be inserted into ball passage and welded or otherwise plugged in place to keep balls 140 in ball races and cone 136 on journal 135.

Additionally, also at any point during the process, a threaded pin 134 may be machined into the upper end of bit body 132 for assembling bit 130 with drill string (not shown). Similarly, beneath threaded pin end 134, bit body 132 may be machined to include bit breaker slots 133. Bit breaker slots 133 may be flat-bottomed recesses cut into the generally cylindrical outer surface of the bit body 132.

In a particular embodiment, the following order of machining steps may be used: (a) initial machining; (b) plenum machining; (c) journal machining; (d) hydraulic opening and passageway machining; (e) ball passageway machining; (f) grease reservoir machining; and (g) grease passageway machining. However, many of these steps may be reversed in accordance with other embodiments of the present disclosure. For example, journal machining may be performed prior to plenum machining, hydraulic machining may occur before journal machining, ball passageway and grease reservoir may be switched, etc. Thus, there exists no limitation on the particular order of steps in which such manufacturing must occur in accordance with the present disclosure.

While FIG. 4 above shows the bit being formed from a single piece, other embodiments of the present disclosure may incorporate the bit body to be assembled from multiple pieces. For example, as shown in FIGS. 5A-5E, the bit body may be formed from a multiple pieces or section cuts of bar stock. In particular, bar stock section 110*a* is machined into a transitional bit body section 111*a* having a single protrusion 115*a* at one end thereof. Protrusion 115*a* extends downward and radially outward from the edge $L_a$ at which multiple bit sections will eventually intersect. One skilled in the art should appreciate after learning the teachings related to the present invention contained in this application that the direction, orientation, etc. of protrusion may be selected based on the ultimate desired direction, orientation, etc. of a bit body journal.

Journal 135*a* may be machined from protrusion 115*a*,as described above with respect to FIG. 4C. Additionally, bit body section 111*a* may also be machined to form a plenum section 170*a*, a hydraulic opening 176*a*, hydraulic passageway 171*a*, and grease reservoir 150 at this time or these steps may be performed after assembly of multiple bit body sections 111*a* (described below). Multiple bit body sections 111*a* may be abutted together and secured together, such as by electron beam welding, to form bit body 132. In electron beam welding, two bit body sections are held together and an electron beam is directed along the junction of the surfaces to weld the two pieces together. Alternatively, hydraulic opening 176*a*, hydraulic passageway 171*a*, and/or plenum section may be formed after the assembly of bit body sections 111*a* together, similar to as described above with respect to the embodiment shown in FIG. 4.

Following welding of the multiple bit body sections 111*a* together to form bit body 132, bit body 132 may be machined or otherwise modified to incorporate other features such as a ball passage, grease reservoir, lubricant passageway, bit breaker slots, threaded pin, as shown above with respect to FIG. 4. Ball passage 141 may be machined into the assembled bit body (but may alternatively be performed prior to assembly), with ball passage 141 transversing bit body 132 a length that is greater than the radius of the bit centerline to ball race in journal. Alternatively, ball passage 141 may be machined in two steps, each step drilling half of the ball passage 141. Lubricant passage 151 is similarly machined following the assembly of the multiple sections (but may alternatively be performed prior to assembly). At any point after the machining of ball passage 141, cone (not shown) may be retained on journal 135 by retention balls (not shown), which are inserted through ball passage 141 and secured in place by a ball retainer (not shown). Also following the assembly of bit body sections 111*a* into bit body 132, a threaded pin 134 may be machined into the upper end of bit body 132 for assembling bit 130 with drill string (not shown).

In some embodiments, ball passages 141 do not extend such a length as described above with respect to FIG. 4. For example, ball passages 141 may be machined into the multiple bit body sections 111*a* so that they only extend approximately to a bit centerline. In such an embodiment, the cones 136 may be retained on the journals 135 prior to assembly of the multiple bit body sections 111*a*.

In a particular embodiment, the following order of manufacturing steps may be used: (a) initial leg section machining; (b) plenum machining; (c) journal machining; (d) hydraulic opening and passageway machining; (e) part one ball passageway machining; (f) grease reservoir machining; (g) grease passageway machining; (h) welding/assembly of multiple sections; and (i) part two ball passageway machining. However, many of these steps may be reversed in accordance with other embodiments of the present disclosure. For example, journal machining may performed prior to plenum machining, hydraulic machining may occur before journal machining, ball passageway and grease reservoir may be switched, etc. Thus, there exists no limitation on the particular order of steps in which such manufacturing must occur in accordance with the present disclosure.

Yet another embodiment of the present disclosure may use upper and lower bit body sections. For example, as shown in FIGS. 6A-D, the bit body may be formed from a multiple pieces or section cuts of bar stock, including an upper section, and multiple lower leg bar stock sections. In particular, bar stock section 112*a* is machined into a lower leg section 113*a* having a single protrusion 115*a* at one end thereof. Protrusion 115*a* extends downward and radially outward from the edge $L_a$ at which multiple leg sections will eventually intersect. One skilled in the art should appreciate after learning the teachings related to the present invention contained in this application that the direction, orientation, etc. of protrusion may be selected based on the ultimate desired direction, orientation, etc. of a bit body journal. Journal 135*a* may be machined from protrusion 115*a*, as described above with respect to FIG. 4C. Multiple lower leg sections 113*a* may be abutted together and secured together, such as by electron beam welding, to form a lower bit body section 116*a*. Alternatively, it is also within the scope of the present disclosure that a bar stock section (not shown) is machined to form a lower bit body half 116*a* (similar to assembled lower leg sections 113*a*).

Lower bit body half 116*a* may be welded to upper bit body half 114*a* to form assembled bit body 132. Upper bit body half 114*a* may have a fluid plenum (not shown) formed therein before assembly, or such plenum may be formed after assembly of bit body 132. Additionally, depending on the height of upper and lower bit body sections, a hydraulic passageway may be machined in the upper bit body section prior to or after assembly with lower bit body section. Similarly, also depending on the height of the upper and lower bit body sections, grease reservoir may be machined in the upper or lower bit body sections, or even the lower leg sections.

Following welding of the multiple lower leg sections 113*a* together to form lower bit body section 116*a* (or following assembly of lower bit body section 116*a* with upper section 114*a* to form bit body 132), ball passage 141 may be machined into the assembled bit body, with ball passage 141 transversing bit body section 116*a* a length that is greater than the radius of the bit centerline to ball race in journal. Lubricant passage 150 and grease reservoir 151 are similarly machined following the assembly of the multiple lower sections 113*a*. At any point after the machining of ball passage 141, cone (not shown) may be retained on journal 135 by retention balls (not shown) and secured in place by ball retainer (not shown). However, while these steps may be performed prior to assembly of lower bit body section 116*a* with upper bit body section 114*a*, they may also be performed after assembly of the lower and upper portions, similar to the embodiments shown in FIGS. 4 and 5.

A threaded pin 134 may be machined into the upper section 114*a* (prior to assembly with lower section 116*a*) or upper end of assembled bit body 132 (after assembly with lower section 116*a*) for assembling bit 130 with drill string (not shown). Additionally, bit breaker slots 133 may also be machined in upper section 114*a* or bit body 132 prior to or after assembly into bit body 132.

In a particular embodiment, the following order of manufacturing steps may be used: (a) initial leg section machining; (b) plenum machining; (c) journal machining; (d) hydraulic opening and passageway machining; (e) part one ball passageway machining; (f) grease reservoir machining; (g) grease passageway machining; (h) welding/assembly of multiple leg sections; (i) part two ball passageway machining; (j) assembly with upper section. However, many of these steps may be reversed in accordance with other embodiments of the present disclosure. For example, journal machining may performed prior to plenum machining, hydraulic machining may occur before journal machining, ball passageway and grease reservoir may be switched, etc. Thus, there exists no limitation on the particular order of steps in which such manufacturing must occur in accordance with the present disclosure.

Referring to FIGS. 7A-L, yet another embodiment of the present disclosure using upper and lower bit body sections is shown. As compared to the embodiment shown in FIG. 6, the embodiment shown in FIG. 7 includes a lower bit body section formed from a single piece. For example, as shown in FIGS. 7A-D, the bit body may be formed from multiple pieces or section cuts of bar stock, including an upper section, and a lower section. In particular, bar stock section 110 is machined into a lower bar stock section 110*a*. At an upper end of lower bar stock section 110*s*, service threads 117 may be cut therein for later attachment to an upper bit body section. Lower bar stock section 110*a* is machined into a transitional bit body section 113 having at least two protrusions 115 at a lower end thereof. Protrusions 115 may be machined into journals 135 extending downardly and radially outwardly from a centerline of bit body section 113. Journal 135 may be machined from protrusion 115, as described above with respect to FIG. 4C.

Figure 7A:
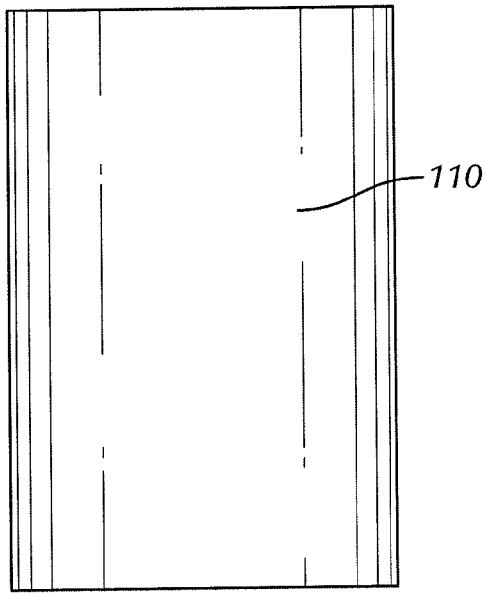
FIGS. 7A-7L show manufacturing stages of a roller cone bit in accordance with one embodiment of the present disclosure.
Figure 7B:
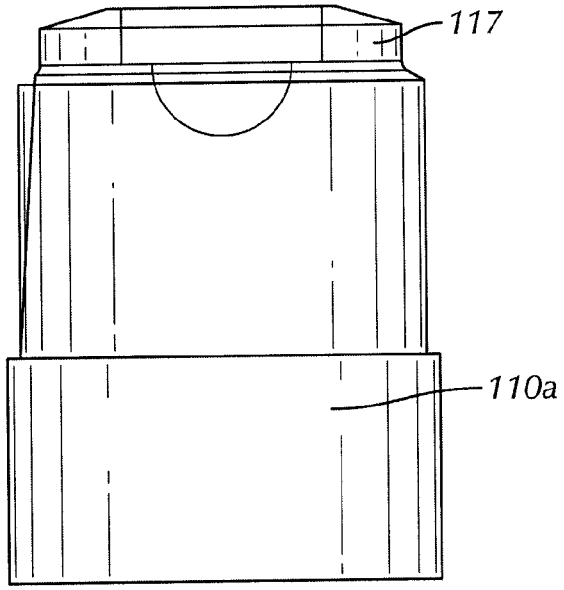
Figure 7C:
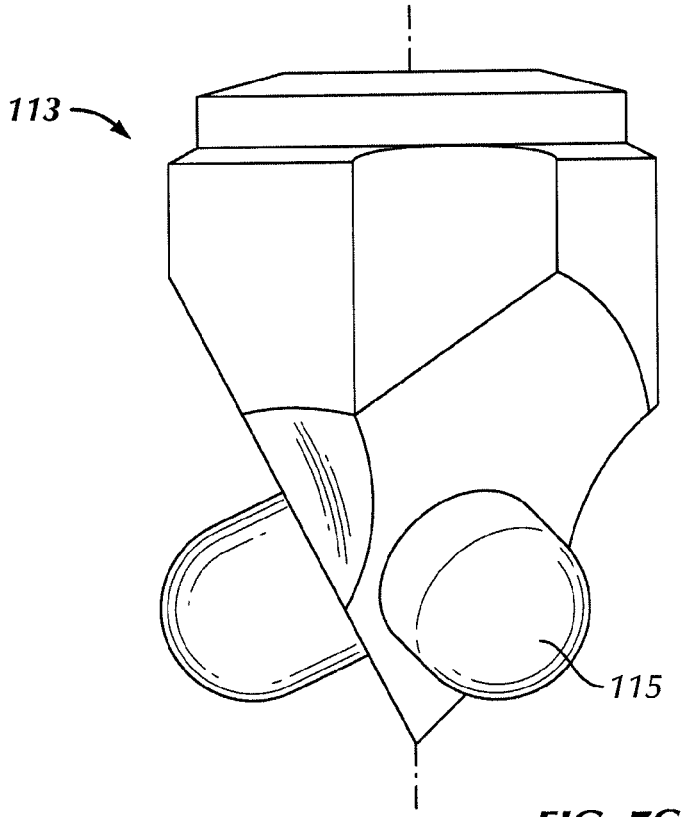
Figure 7D:
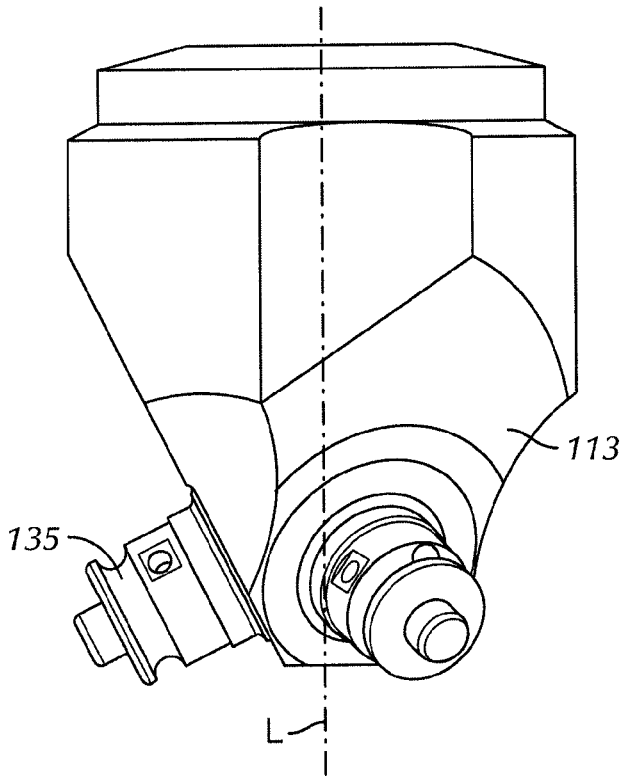
Figure 7E:
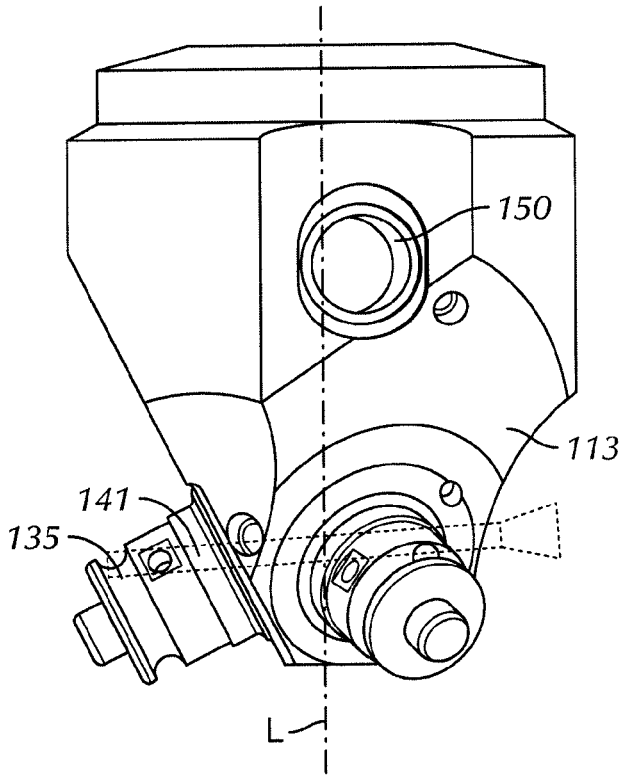
Figure 7F:
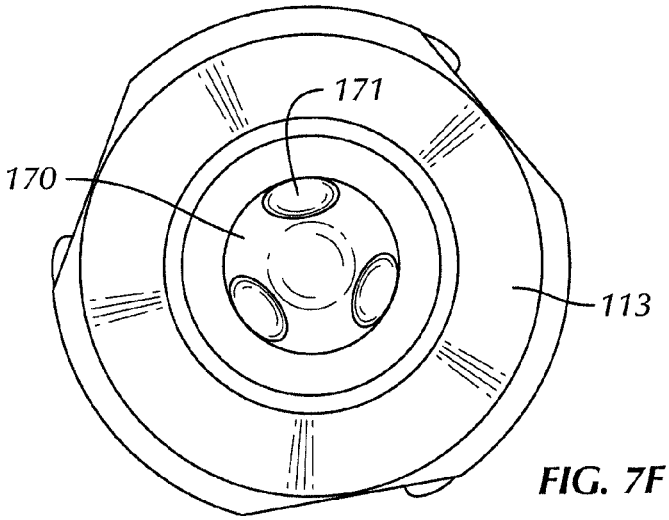
Figure 7G:
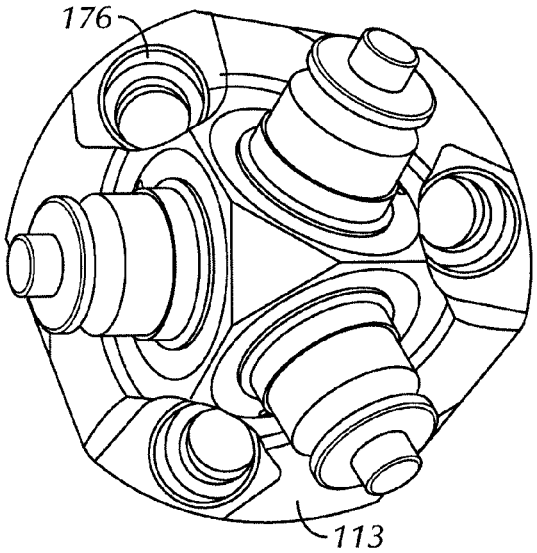
Figure 7H:
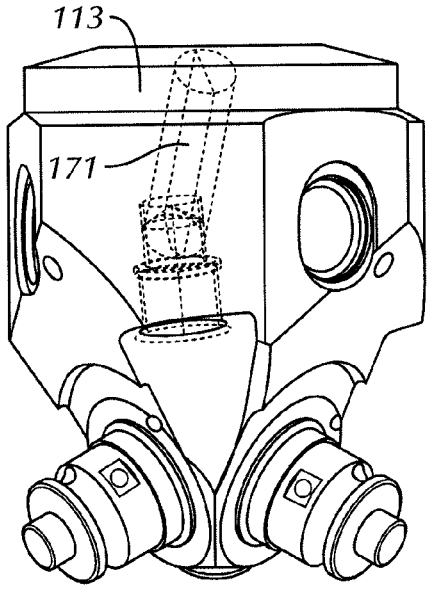
Figure 7I:
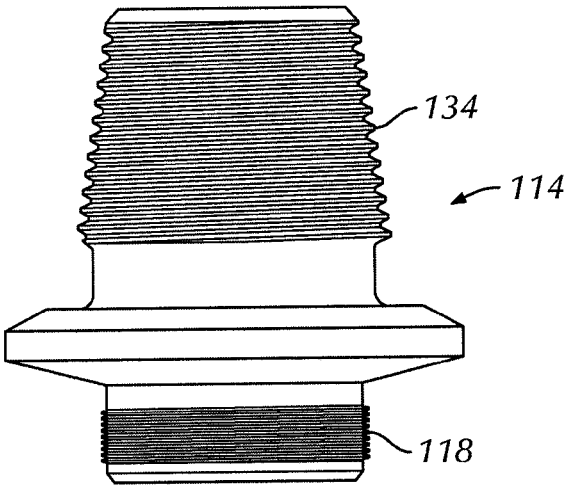
Figure 7J:
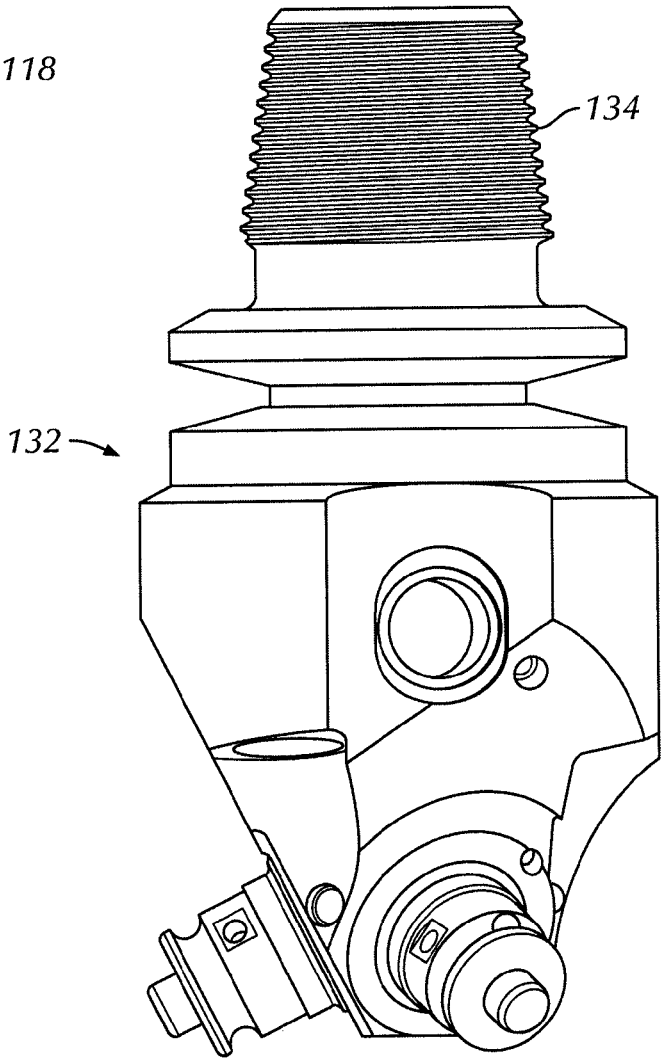
Figure 7K:
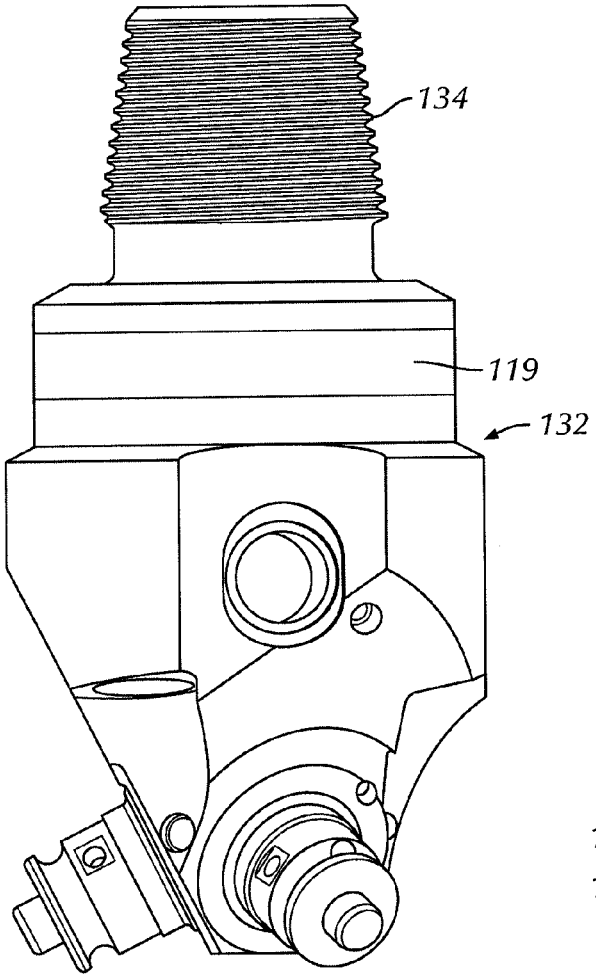
Figure 7L:
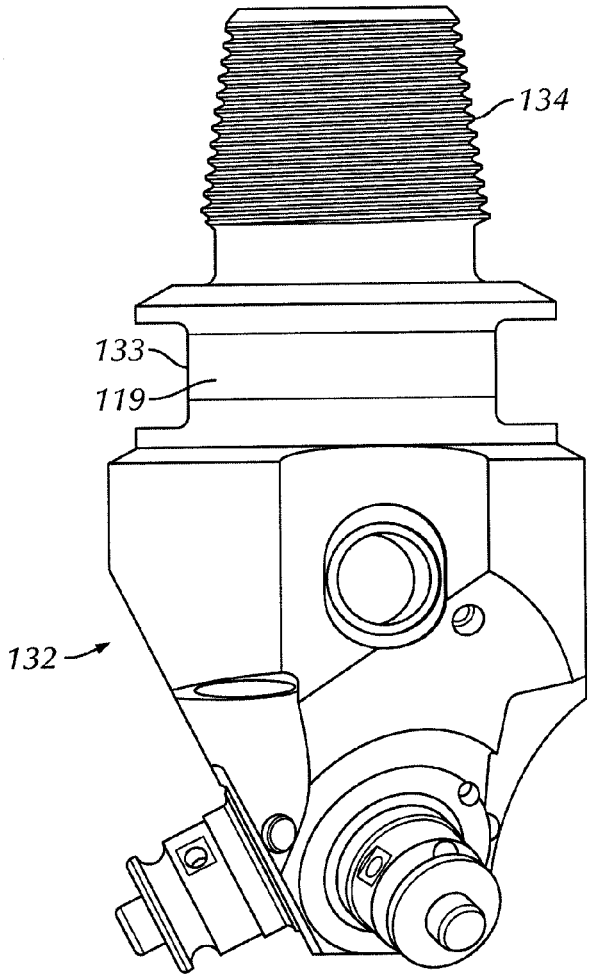

Prior to (or after) journal machining, grease reservoirs 150 may be machined into the bit body 132 in a location axially above each journal 135, shown in FIG. 7E. Each reservoir 150 supplies grease for the journal 135 above which the reservoir 150 is located. Additionally, ball passage 141 may be machined into the lower bit body section, with ball passage 141 transversing bit body section 113 a length that is greater than the radius of the bit centerline to ball race in journal. Lubricant passageways may similarly be machined in the bit body, as described above with respect to FIG. 4E-F. At any point after the machining of ball passage 141, cone (not shown) may be retained on journal 135 by retention balls (not shown) and secured in place by ball retainer (not shown). However, while these steps may be performed prior to assembly of lower bit body section 113 with upper bit body section 114, they may also be performed after assembly of the lower and upper portions, similar to the embodiments shown in FIGS. 4 and 5. Bit body section 113 may also be machined to form a plenum section 170, a hydraulic opening 176, and hydraulic passageway 171 either before or after journal machining.

The interior surface of upper end of lower bit body section 113 may be machined to form internal threads therein, as a box connection (117 in FIG. 7B). Such box may receive a threaded pin 118 on the lower end of upper section 114. Threaded pin 134 may be machined into the upper section 114 (prior to assembly with lower section 113) or upper end of assembled bit body 132 (after assembly with lower section 116) for assembling bit 130 with drill string (not shown). Following threading the lower section 113 to upper section 114, a weld overlay 119 may secure the threaded connection. Following welding, bit breaker slots 133 may also be machined in bit body 132 for attaching the bit to a drill string (not shown).

Figure 8A:
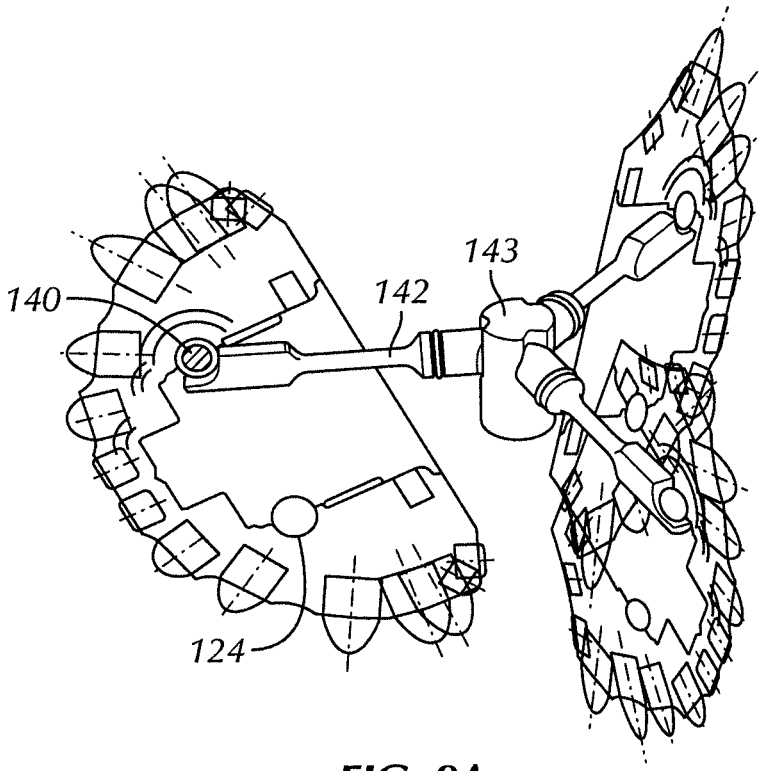
FIGS. 8A-8B show embodiments for retaining cones on a roller cone bit in accordance with embodiments of the present disclosure.

As discussed above, with respect to FIG. 4G, for a three cone bit having ball passages 141 that intersect, cones may be retained on journal 135 by installation of balls 140 through ball passage 141 into ball race 124 (shown in FIG. 4C). A ball retainer 142 (having one end shaped to compliment the ball race 124 geometry) may be inserted into ball passage and welded or otherwise plugged in place to keep balls 140 in ball races and cone 136 on journal 135. For example, as shown in FIG. 8A, after balls 140 are inserted into ball passage 141 to fill ball race 124 and after ball retainers 142 are inserted to the ball passage 141 behind balls 140 a single, center plug 143 may be inserted through a center hole (machined into the bit body at its the lowest axial position). Center plug 143 may operate to keep ball retainers 142 in place, while an optional back hole plug (144 in FIG. 4G) may also be inserted into ball passage 141 to prevent debris, fluid, etc., from filling ball passage 141. In the embodiment shown in FIG. 8A, once in place, each of the ball retainers 142 extend a distance from the ball race to less than the centerline of the bit.

Figure 8B:
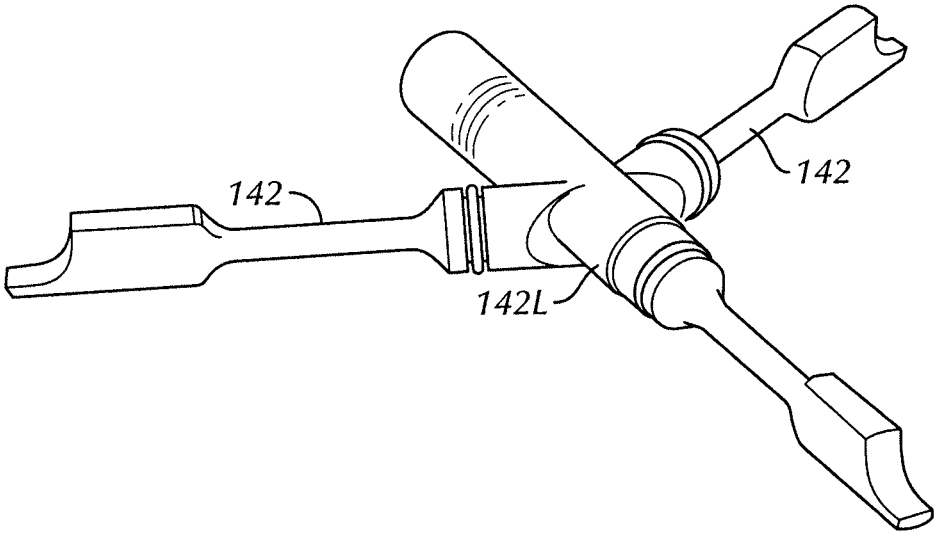

Alternatively, as shown in FIG. 8B, two "short" retainers 142, similar as those shown in FIG. 8A, are used in conjunction with a "long" ball retainer 142L (extending a distance greater than that between the race 124 and the centerline). One end of the ball retainers 142 and 142L are shaped to compliment the ball race 124 geometry, while the other ends of the retainers 142 are shaped to compliment the geometry of the long retainer 142L (whereas retainers 142 are shaped to compliment the center plug 143 in the embodiment shown in FIG. 8A). Thus, long retainer 142L serves to keep ball retainers 142 and itself (through its dimensions) in place. Optional back hole plugs (144 in FIG. 4G) may also be inserted into ball passage 141 behind short retainers 142 to prevent debris, fluid, etc., from filling ball passage 141.

Figure 9:
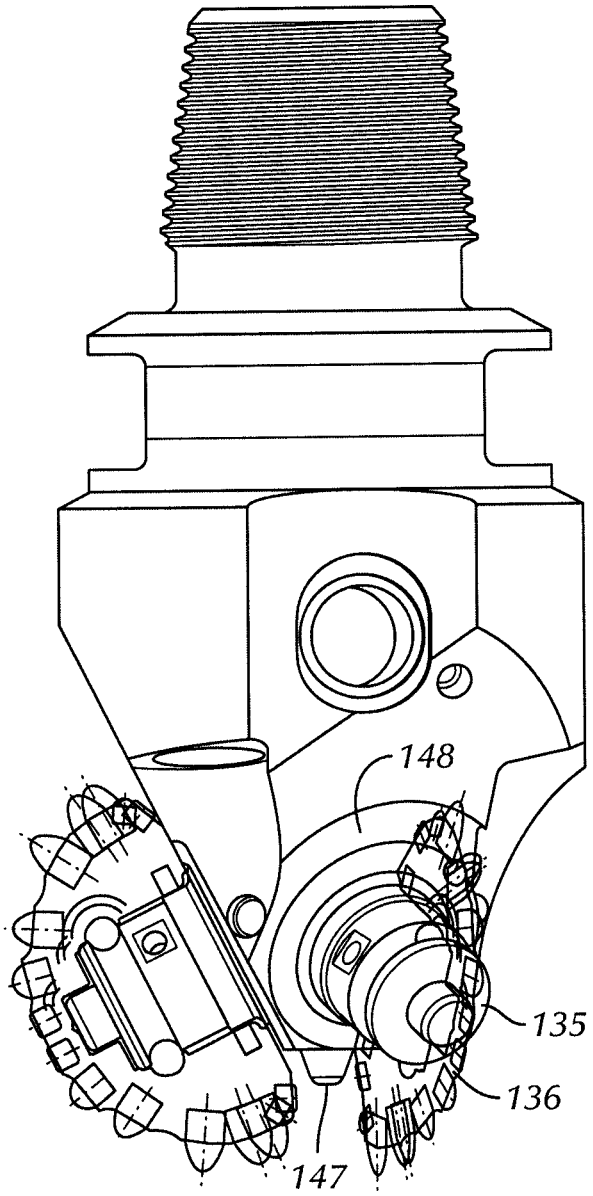
FIG. 9 shows one embodiment of a roller cone bit manufactured in accordance with methods of the present disclosure.

When a center hole is formed in bit body to receive a center plug 143, a center insert 147, as shown in FIG. 9, may optionally be inserted therein, to assist in cutting of a center core of formation. Alternatively, even when a center plug is not used (such as when using a long retainer in combination with the short retainers), it may still be desirable to include such a center insert, for assistance in cutting the center core. Further, if a center jet (not shown) is used, the center plug 143 may optionally be hollow so that the jet may be in fluid communication with the plenum 170 and a hydraulic passageway 171.

Also shown in FIG. 9 is a partially circumferential groove 148 that may be formed in bit body 132 adjacent journal 135. Cone 136 forms a backface that is adjacent to the groove 148 formed on the bit body 132. The partially circumferential groove 148 and the cone backface are normal to a rotary axis of the cone 136. Such grooves are similar to those described in U.S. Pat. No. 5,358,061, which is assigned to the present assignee and herein incorporated by reference in its entirety. In embodiments where different cone shapes and sizes are used, the groove may be varied in its depth and width to account for the differences in the corresponding cones.

Figure 10A:
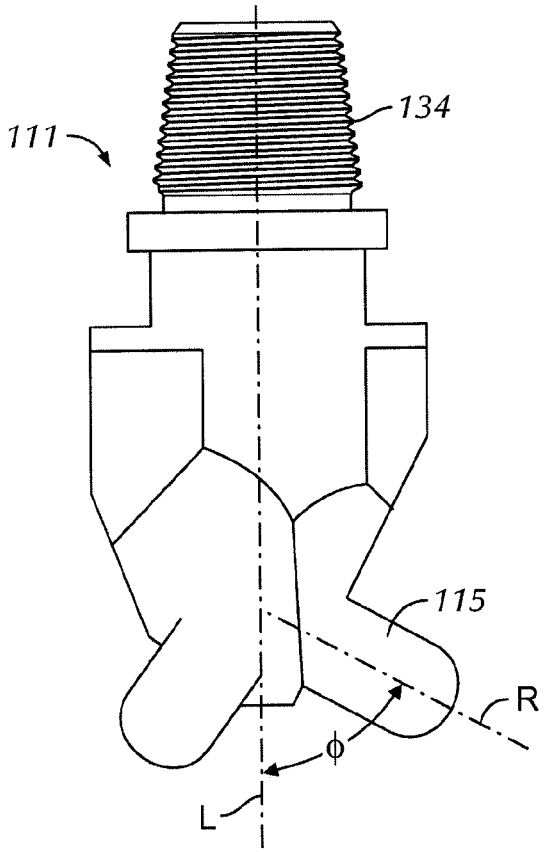
FIGS. 10A-10C show various orientations of protrusions in the manufacture of a roller cone bit in accordance with various embodiments of the present disclosure.

As described above, protrusions 115 (or 115*a*) extend downward and radially outward from a centerline or longitudinal axis L. When protrusions 115 are machined, they may be machined at particular angles so that eventual journals 135 and cones 136 will be oriented in the desired direction. For example, as shown in FIG. 10A, protrusion 115 extends downward and radially outward from longitudinal axis L of transitional bit body 111 such that an acute angle $\phi$ is formed between protrusion axis R and longitudinal axis L. Likewise, for embodiments using multiple bit body sectional pieces (shown in FIGS. 5 and 6, protrusion 115*a* extends downward and radially outward from the edge $L_a$ at which multiple bit sections will eventually intersect. According to various embodiments of the present disclosure, $\phi$ may broadly range from 15 to 70 degrees. However, in particular embodiments, $\phi$ may range from any lower limit of 40, 45, 50, 60 or 65 degrees to any upper limit of 60, 65, or 70 degrees. In a more particular embodiment, $\phi$ may range from 50 to 60 degrees. One skilled in the art should appreciate after learning the teachings related to the present invention contained in this application that the journal angle (as that term is used in the art) is related to $\phi$. In particular, the journal angle is defined in the art as the angle formed by a line perpendicular to the axis of a bit and the axis of the journal and thus may be equal to 90-$\phi$. Selection of $\phi$ (and journal angle) may be based factors such as the relative cone size (and desired cone size), the type of cutting action desired (shearing, scraping, rolling), formation type, the number of cutting element desired to contact the bottom hole at one time, desired cone rotation speed, desired shear/indention ratio, desired core size, etc. For example, in a soft formation (where greater shearing is desired), it may be desirable for $\phi$ to range from 60 to 70 degrees whereas in a hard formation (where greater rolling is desired), it may be desirable for $\phi$ to range from 40 to 60 degrees.

While FIG. 10A shows the protrusion angle $\phi$ for a single protrusion, one skilled in the art should appreciate after learning the teachings related to the present invention contained in this application that each protrusion may have a protrusion angle $\phi$1, $\phi$2, etc., which may be the same or different from the other protrusions. For example, as shown in FIG. 10B, another embodiment may allow for differing acute journal angles $\phi$1, $\phi$2 formed between protrusion axes R1, R2 and longitudinal axis L for protrusion 115*b* and protrusion 115*c*.

Figure 10B:
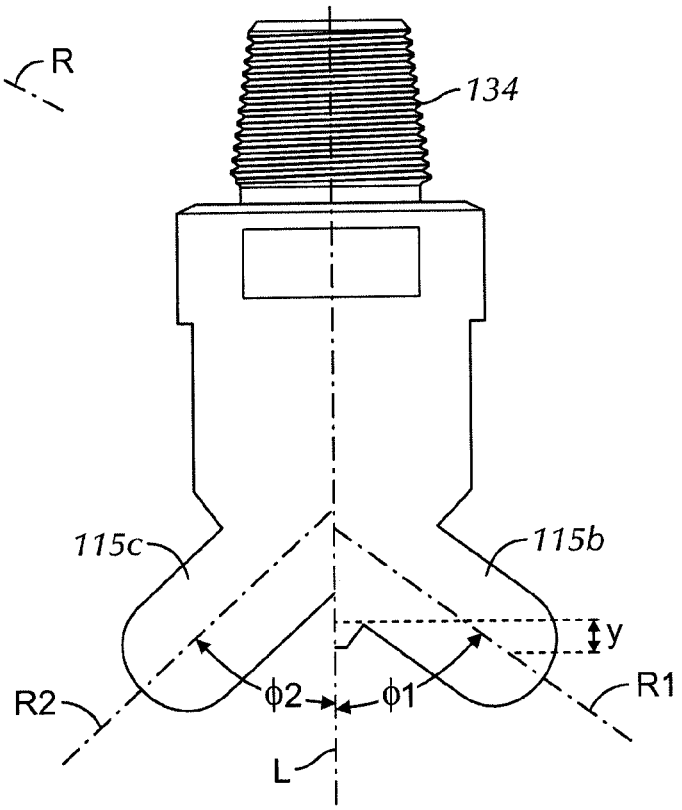

In addition to different angle extension between protrusions 115*b* and 115*c*, as also shown in FIG. 10B, protrusions 115*b* and 115*c* may be machined to extend from different axial locations of transitional bit body 111. For example, protrusion 115*b* may be axially distanced or separated from protrusion 115*c* on a bit. Such axial separation y may be measured from any two points on the protrusions, such as the nose of the protrusion, as shown in FIG. 10B.

Figure 10C:
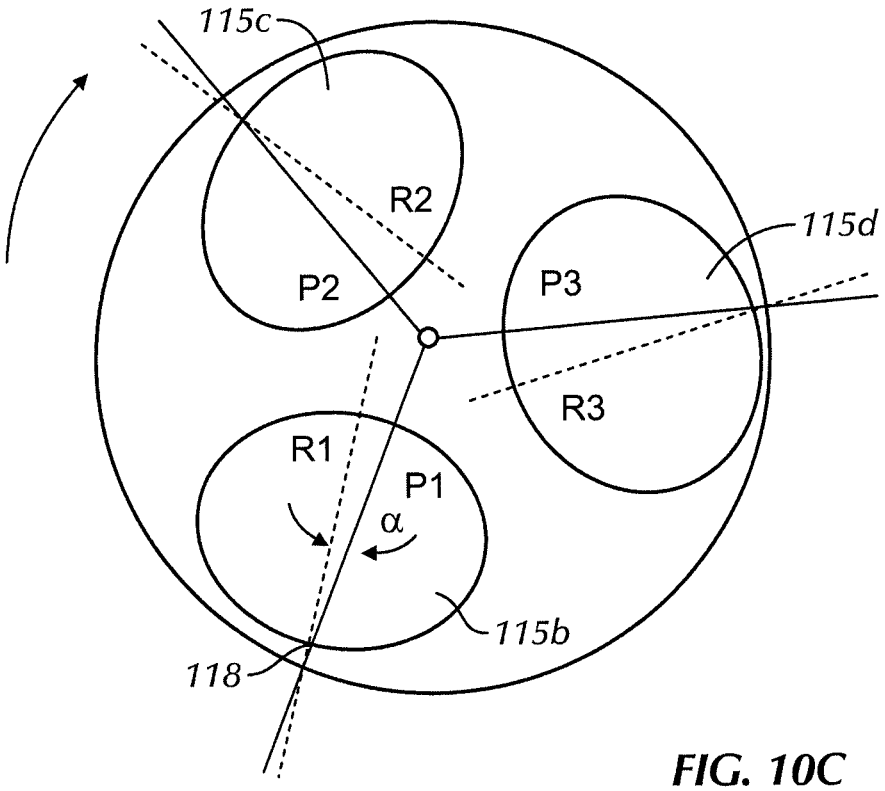

In some embodiments, the protrusions 115 may be provided with an offset, as shown in FIG. 10C, to result in a journal/cone offset. Offset can be determined by viewing the drill bit (or transitional shape) from the bottom on a horizontal plane that is perpendicular to the center axis L. Offset, represented as $\alpha$, is the angle between a protrusion axis R and a line P on the horizontal plane that intersects the center axis L and the nose 118 of protrusion 115. A positive offset is defined by an angle opening with the direction of rotation of the drill bit. A negative offset is defined by an angle against the direction of rotation of the drill bit. As shown in FIG. 10C, a positive offset is provided for each protrusion 115; however, in other embodiments, any combination of positive and/or negative offsets or only negative offsets may be used. Additionally, protrusion offset (journal/cone offset) may be used alone or in combination with varying protrusion separation angles (journal/cone separation angles). Specifically, when a protrusion axis is offset or skewed with respect to the centerline of the bit, the protrusion separation angle may be determined by the angle formed between two lines P (e.g., P1 and P2) on the horizontal plane that intersect the center axis L and the nose 118 of protrusion 115. In a particular embodiment, any number of cones (one or more or all) may be provided with zero or no offset, different offset directions and/or different magnitudes of offset. For example, in embodiments where one cone is larger than the others, it may be desirable for that cone to at least have a different magnitude of offset. Further, when offsets are provided, the offsets may require cones to be mounted on the journal depending on the type and magnitudes of the offset as well as the cone size.

The transitional bit body 111 shown in FIG. 10 has three protrusions 115, each having a separation angle of 120° (angle between pairs of neighboring protrusion axis R1, R2, and R3 (or P1, P2, or P3) when projected upon a horizontal plane that is perpendicular to the center axis L of the drill bit). However, in other embodiments the angles between neighboring protrusions need not be uniform. Further, one skilled in the art should appreciate after learning the teachings related to the present invention contained in this application that the present disclosure is not limited to bits having three protrusions, but equally applies to bits having any number of multiple protrusions, including for example, two or four. One skilled in the art should appreciate after learning the teachings related to the present invention contained in this application that the angle between protrusions (i.e., cones), may depend, in some part, on the number of cones on a bit, but may also depend based on other desired cone separation angle variances.

Embodiments of the present disclosure may provide at least one of the following advantages. The methods of the present disclosure may provide for a bit having an outwardly directed journal and cone, which may provide unique cutting actions, and a bit that is suitable for directional drilling and that holds good toolface angle during drilling. Additionally, the configuration may allow for replacement of cones, allowing for repairability, which is otherwise not available to roller cone bit technology. Further, there exists greater flexibility in manufacturing options as to starting piece, and order of manufacturing steps.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of manufacturing a roller cone drill bit, comprising:

forming a body of a single piece having an upper end and a lower end;

machining at the lower end of the body at least two protrusions extending downward and radially outward from a central axis of the body;

machining the at least two protrusions into at least two journals;

machining a ball race in one of the at least two journals;

machining a ball passage, wherein a path of the ball passage traverses from the ball race in the one of the at least two journals radially inward into the body to an outwardly facing surface of the lower end of the body; and mounting roller cones on the at least two journals.

2. The method of claim 1, further comprising machining a ball race opening on the one of the at least two journals.

3. The method of claim 2, wherein the path of the ball passage transverses the body a total length that is greater than a length of a radius from a longitudinal axis of the bit to the ball race opening in the one of the at least two journals.

4. The method of claim 3, further comprising:

loading a plurality of balls into the ball passage; and plugging the ball passage.

5. The method of claim 2, further comprising inserting a plurality of retention balls through the ball passage to the ball race opening.

6. The method of claim 5, further comprising retaining the roller cones on the one of the at least two journals with the plurality of retention balls.

7. The method of claim 5, further comprising inserting a ball retainer into the ball passage.

8. The method of claim 7, wherein the ball retainer is mechanically retained in place.

9. The method of claim 1, further comprising:

machining threads at the upper end of the body to form a pin.

10. The method of claim 1, further comprising:

machining bit breaker slots into the body adjacent the upper end.

11. The method of claim 1, further comprising machining a lubricant passageway and machining a grease reservoir such that the lubricant passageway extends from an opening in the grease reservoir to an opening in the ball passage.

12. The method of claim 1, machining a fluid plenum in the body.

13. The method of claim 1, further comprising machining a second ball passage in a second of the at least two journals such that the ball passage and the second ball passage are interconnected.

14. The method of claim 1, further comprising machining a cylindrical bearing surface on the one of the at least two journals.

15. The method of claim 14, further comprising machining a grease hole in the cylindrical bearing surface.

16. The method of claim 15, wherein the grease hole is configured to intersect with the ball passage.

17. The method of claim 1, further comprising machining a thrust flange at a lower end of one of the at least two journals.

18. The method of claim 1, further comprising machining a second ball passage in a second of the at least two journals such that the ball passage and the second ball passage are interconnected; further comprising:

machining a ball race opening on each the at least two journals;

machining a center hole in the body at the lowest axial position of the body;

inserting a plurality of retention balls through each of the ball passages to the ball race openings, thereby retaining the roller cones on the at least two journals with the plurality of retention balls;

inserting a ball retainer into each of the ball passages; and inserting a center plug through a center hole, thereby retaining the ball retainers.

19. A method of manufacturing a roller cone drill bit, comprising:

forming a body of a single piece having an upper end and a lower end;

machining at the lower end of the body at least two protrusions extending downward and radially outward from a central axis of the body;

machining the at least two protrusions into at least two journals;

machining a ball race in one of the at least two journals; machining a ball race opening on the one of the at least two journals; machining a ball passage, wherein the ball passage transverses the body a total length that is greater than a length of a radius from a longitudinal axis of the bit to the ball race opening in one of the at least two journals; and mounting roller cones on the at least two journals.

* * * * *